US010520271B2

(12) United States Patent
Barrett

(10) Patent No.: US 10,520,271 B2
(45) Date of Patent: Dec. 31, 2019

(54) INTEGRALLY SUPPRESSED HANDGUN

(71) Applicant: Sturm, Ruger & Company, Inc., Southport, CT (US)

(72) Inventor: Jonathan Barrett, Georges Mills, NH (US)

(73) Assignee: STURM, RUGER & COMPANY, INC., Southport, CT (US)

( * ) Notice: Subject to any disclaimer, the term of this patent is extended or adjusted under 35 U.S.C. 154(b) by 0 days.

(21) Appl. No.: 16/267,547

(22) Filed: Feb. 5, 2019

(65) Prior Publication Data

US 2019/0242668 A1 Aug. 8, 2019

Related U.S. Application Data

(60) Provisional application No. 62/626,450, filed on Feb. 5, 2018.

(51) Int. Cl.
*F41A 21/30* (2006.01)
*F41A 21/28* (2006.01)

(52) U.S. Cl.
CPC ..... *F41A 21/30* (2013.01); *F41A 21/28* (2013.01)

(58) Field of Classification Search
CPC ..... F41A 21/30; F41A 21/28
USPC ..... 89/14.4
See application file for complete search history.

(56) References Cited

U.S. PATENT DOCUMENTS

| | | | |
|---|---|---|---|
| 4,479,418 | A | 10/1984 | Beretta |
| 5,136,924 | A | 8/1992 | Forster et al. |
| 8,162,100 | B2 | 4/2012 | Shults et al. |
| 8,584,794 | B2 | 11/2013 | Dueck |
| 8,910,745 | B2 | 12/2014 | Latka |
| 8,973,481 | B2 | 3/2015 | Dueck et al. |

(Continued)

FOREIGN PATENT DOCUMENTS

| | | |
|---|---|---|
| CN | 203364656 U | 12/2013 |
| WO | 2016131516 | 8/2016 |
| WO | 201744586 | 3/2017 |
| WO | 2017102132 | 6/2017 |

OTHER PUBLICATIONS

AWC Silencers. Amphibian II | AWC Silencers. Internet at: https://awcsilencers.com/shop/amphibian-ii/. Printed: Jun. 27, 2017.

(Continued)

*Primary Examiner* — Reginald S Tillman, Jr.
(74) *Attorney, Agent, or Firm* — The Belles Group, P.C.

(57) ABSTRACT

An integrally suppressed firearm in one embodiment includes a rear firing portion defining an axial projectile bore and front suppressor portion. The suppressor portion includes a longitudinal stack of sound suppression baffles each defining a gas expansion chamber in fluid communication with the projectile bore. A mounting rod extends rearward from a front end cap of the suppressor portion and threadably engages a mounting adapter that removably couples the suppressor portion to the firing portion. A muzzle cap disposed inside a rearmost baffle removably couples the mounting adapter to the firing portion. When tightened, the rod axially compresses the baffle stack and forms a combustion gas tight enclosure without need for an additional external pressure retention tube or sleeve. The baffles are configured to form a press-fit frictional interlock with each other such that the baffle stack is self-supporting. An optional accessory rail may be coupled to the adapter.

32 Claims, 31 Drawing Sheets

(56) References Cited

U.S. PATENT DOCUMENTS

| | | | | |
|---|---|---|---|---|
| 9,097,482 | B1 | 8/2015 | Holden et al. | |
| 9,482,483 | B2 | 11/2016 | Whelan | |
| D778,389 | S | 2/2017 | Holden et al. | |
| 9,835,400 | B2 | 12/2017 | Barrett et al. | |
| 10,030,929 | B1 * | 7/2018 | Lessard | F41A 21/30 |
| 2008/0148928 | A1 | 6/2008 | McClellan | |
| 2014/0157640 | A1 | 6/2014 | Whelan | |
| 2015/0090105 | A1 | 4/2015 | Pace | |
| 2015/0362276 | A1 | 12/2015 | Fischer | |
| 2016/0003570 | A1 | 1/2016 | Tonkin | |
| 2016/0209149 | A1 | 7/2016 | Fischer | |
| 2016/0298916 | A1 | 10/2016 | Anderson et al. | |
| 2017/0074613 | A1 | 3/2017 | Shults et al. | |
| 2017/0191779 | A1 | 7/2017 | Myers | |
| 2017/0205173 | A1 | 7/2017 | Thomas et al. | |

OTHER PUBLICATIONS

AWC Silencers. Amphibian II Buckmark | AWC Silencers. Internet at: https://awcsilencers.com/shop/amphibian-ii-buckmark/. Printed: Jun. 27, 2017.

Ammoland Shooting Sports News. Gemtech Oasis: Integral Suppressed .22 Pistol the Ruger 10/22. Internet at: https://www.ammoland.com/2008/12/gemtech-oasis-integral-suppressed-22-pistol-the-rugera-1022a/#axzz4IDcUoZJU. Printed: Jun. 27, 2017.

SWS Suppressed Weapon Systems. Bolt Action Rifles, Monolithic Integral Suppressed Barrels | Suppressed Weapon Systems. Internet at: http://www.suppressedweaponsystems.com/products/bolt-actions/. Printed: Jun. 27, 2017.

International Search Report and Written Opinion from PCT/US2019/16586 dated May 31, 2019, pp. 1-11.

* cited by examiner

INTEGRALLY SUPPRESSED HANDGUN

CROSS-REFERENCE TO RELATED APPLICATIONS

The present application claims the benefit of U.S. Provisional Application No. 62/626,450 filed Feb. 5, 2018; the entirety of which is incorporated herein by reference.

BACKGROUND OF THE DISCLOSURE

The present disclosure generally relates to firearms, and more particularly to firearms in the form of handguns with integral silencers or suppressors that reduce muzzle noise or blast produced by discharging the firearm.

Silencers or suppressors generally comprise multiple combustion gas expansion chambers in which the high pressure gas is allowed to partially expand prior to leaving the firearm. The projectile such as a bullet is propelled through the barrel of the firearm and silencer by the combustion gas. In an unsuppressed discharge firearm, the rapid expansion and depressurization of the high pressure gas at the muzzle end of the barrel produces a loud sound referred to as muzzle blast or noise. The partial pre-expansion of gas inside the silencer acts to reduce muzzle noise which is desirable in some circumstances.

Silencers are typically configured as separate thread-on assemblies having an outer sleeve and internal sound suppression baffling which are screwed onto the muzzle end of the firearm barrel as a completely removable unit. Although some attempts have been made to integrate silencers into handguns such as a pistol, the end result is that these units may tend to be long, bulky, and cumbersome to handle. In addition, these designs may be difficult to disassemble for maintenance and cleaning of the silencer and/or firearm components. Accordingly, such prior integrated silencer designs may adversely affect the balance, aiming, and desired slim profile of the barrel creating a suppressed pistol uncharacteristic in dimensions and appearance from a more conventional pistol.

Improvements in integrally suppressed handguns are needed.

SUMMARY OF THE DISCLOSURE

The present invention provides an integrally suppressed handgun that overcomes the shortcomings of the foregoing integrally suppressed handgun designs. The present suppressed handgun may be in the form of a semi-automatic pistol in one non-limiting configuration. The present integrally suppressed pistol has a silencer or suppressor design which advantageously is relatively compact with a slim profile characteristic of an unsuppressed pistol to facilitate aiming and holstering. The baffled front suppressor portion of the pistol can be readily assembled or disassembled for maintenance and cleaning of the suppressor components or other parts of the firearm via an easy-operating coupling system.

In one non-limiting embodiment, the integrally suppressed pistol generally comprises a suppressor assembly, which may be removably mounted to the pistol via a mounting adapter. The suppressor mounting adapter may be configured for direct coupling to a barrel insert fixedly attached to a receiver and the receiver. No discernable gap may exist between the rear end of the mounting adapter which abuts the front of the receiver for a uniform appearance and stability. The barrel insert provides support for the adapter and suppressor components coupled thereto in a cantilevered manner. In one embodiment, the barrel insert may be internally ported inside the suppressor mounting adapter to increase combustion gas retention time and improve sound suppression performance.

The suppressor components comprise a stack of sound suppression baffles removably affixed directly to and supported by the adapter. There is no outer silencer sleeve or tube that supports the baffles unlike many prior suppressor designs. The exterior walls of the baffles therefore form the exposed outer surfaces of the front suppressor portion of the firearm. The baffles may have a vertically oblong configuration in one embodiment defining a gas expansion chamber including an upper portion or volume aligned with the centerline of barrel bore and a lower portion or volume which extends below the barrel's normal cross section and centerline of the bore to provide additional volume for gas expansion, thereby advantageously improving sound suppression performance while minimizing the length of the silencer compared to conventional designs.

The stackable baffles of the suppressor may detachably attach to the mounting adapter via an axially elongated mounting rod which may be socket head cap screw that is threaded into a threaded steel insert disposed in the adapter. Tightening the cap screw places the baffles in compression, which seals the byproducts of combustion inside the suppressor. Unscrewing the socket head cap screw from the adapter allows for removal of the baffles from the suppressor for cleaning. The adapter may be removably affixed to the barrel insert of the firearm by means of a threaded retention or muzzle cap rotatably/threadably coupled to muzzle end of the barrel insert. The muzzle cap places the adapter in compression and acts as a positional locator for the blast baffle of the suppressor assembly.

A rearmost gas expansion chamber referred to as a "blast chamber" is defined by an upper portion of the blast baffle which is affixed to the mounting adapter. The blast chamber provides an initial volume that receives combustion gases from the barrel bore when the firearm is discharged to control the effects of 1st-round "pop" (secondary ignition of oxygen within the suppressor, which results in a louder than normal report from the firearm when first fired). The next and subsequent gas expansion chambers forward within the suppressor formed by baffles referred to as "primary baffles" herein fluidly communicate with the blast chamber of the blast baffle. The blast baffle includes additional gas expansion volume beneath the blast chamber to further ameliorate the muzzle blast. The primary baffles may utilize an obliquely angled pushed or skewed cone geometry in one embodiment, as further described herein.

The suppressor is length-configurable by a user or manufacturer advantageously without the need for additional components via the flexible length coupling system disclosed herein. When one or two of the baffles are removed from a long configuration, the mounting rod (e.g. socket head cap screw) can be threaded deeper through a double open-ended socket in the suppressor mounting adapter and into an extended length chamber to place the remainder of the baffle stack in compression, thereby forming a short configuration. The short configuration, having two baffles removed from the assembly for example without limitation, is still hearing-safe for the shooter (below 140 dB). In this configuration, the pistol has an overall length more appropriate easy holstering and on-person carry. The mounting rod has a sufficient length to allow for its use in both the short and long configurations, thereby advantageously negating the need to provide additional sets of mounting rods for the short and long suppressor and pistol configurations. In one embodiment, the mounting rod may be extendible and retractable into and out of a rear chamber of the mounting adapter to vary a projected length of the mounting rod from the mounting adapter for accommodating the different numbers of baffles in the baffle assembly for different configurations of the suppressor.

The front-most baffle may be machined to accept a standard, 1911 dovetailed pistol front sight, which allows end users to install off the shelf components for further customization. Other types of sights may be mounted to the front-most baffle.

In one embodiment, the pistol may include a tilting barrel-receiver assembly pivotably mounted to the grip frame of the firearm for ease of maintenance. The barrel-receiver assembly is movable between a closed position axially aligned with a longitudinal axis of the firearm and an open position obliquely angled thereto. In other possible embodiments, the barrel-receiver assembly may be fixed in position and non-tilting.

A plastic or metal accessory rail may be provided in some embodiments and attached via socket head cap screws to the underside of the mounting adapter. The accessory rail, besides being designed to accept Picatinny-rail-mounted accessories or other available type rail mounting accessories, may be configured to allow for the pistol grip frame to rotate down far enough for the bolt assembly to be removed from the receiver for cleaning.

In one implementation of the present invention, an integrally-suppressible pistol is provided having a stock configuration and components as provided by the manufacturer which are amenable for conversion to an integrally suppressed firearm by the purchaser or end user via use of an available integral suppressor conversion kit. Advantageously, the conversion may be accomplished without resort to a gunsmith. In addition, the user may easily switch back and forth between the unsuppressed and integrally suppressed firing platforms in a matter of minutes to suit changing needs and circumstances.

In one aspect, an integrally suppressed handgun comprises: a longitudinal axis; a frame; a receiver attached to the frame; an elongated barrel insert comprising a rearward mounting portion fixedly coupled to the receiver and a forward retention portion, the barrel insert comprising a rear breech end defining a chamber configured for holding an ammunition cartridge, a front end, and a longitudinally-extending barrel bore defining a projectile pathway; the barrel insert further comprising a plurality of radial gas ports in fluid communication with the barrel bore; a suppressor mounting adapter at least partially surrounding and removably coupled to the barrel insert, the mounting adapter comprising an upper through passage receiving the barrel insert at least partially therein and a lower through passage; an annular gas expansion chamber formed between the barrel insert and the mounting adapter in the upper through passage; a threaded muzzle cap removably coupling the mounting adapter to the barrel insert; a baffle assembly removably coupled to the mounting adapter and defining a front end of the handgun including a projectile exit aperture, the baffle assembly comprising a plurality of sound suppression baffles arranged in longitudinally stacked relationship, each baffle defining an internal baffle gas expansion chamber; and an elongated mounting rod extending from the front end of the baffle assembly rearward to the mounting adapter, a threaded rear end of the mounting rod threadably coupled to the mounting adapter to retain the baffle assembly; wherein when the handgun is discharged, the annular gas expansion chamber fills with combustion gas vented from the gas ports of the barrel insert.

In another aspect, an integrally suppressed handgun comprises: a longitudinal axis; a frame; a receiver supported by the frame; an elongated barrel insert comprising a rearward mounting portion fixedly coupled to a front end of receiver, a forward retention portion, and an intermediate portion therebetween; the barrel insert comprising a rear breech end defining a chamber configured for holding an ammunition cartridge, a front end, and a longitudinally-extending barrel bore defining a projectile pathway; the barrel insert further comprising a plurality of radial gas ports in fluid communication with the barrel bore; a mounting adapter configured for attaching a suppressor baffle assembly thereto, the mounting adapter at least partially surrounding the barrel insert and abuttingly engaging the receiver; a muzzle cap threadably coupled to the forward retention portion of the barrel insert to secure the mounting adapter to the receiver; the muzzle cap comprising a forward tooling portion configured for engaging a tool used to couple the muzzle cap to the barrel insert, and a rear shield portion defining a rearwardly open inlet gas chamber in fluid communication with the radial gas ports of the barrel insert; the mounting adapter further defining an internal annular gas expansion chamber surrounding the barrel insert, the annular gas expansion chamber in fluid communication with the radial gas ports of the barrel insert via the inlet gas chamber of the muzzle cap; wherein when the handgun is discharged, combustion gas is vented from the barrel bore into the gas inlet chamber of the muzzle cap through the radial gas ports, and then fills the annular gas expansion chamber.

In another aspect, an integrally suppressed handgun comprises: a longitudinal axis; a frame; a receiver attached to the frame and including a front end; an elongated barrel insert comprising a rearward mounting portion fixedly coupled to the front end of receiver and a forward retention portion, the barrel insert comprising a rear breech end defining a chamber configured for holding an ammunition cartridge, a front end, and a longitudinally-extending barrel bore defining a projectile pathway; the barrel insert further comprising a plurality of radial gas ports in fluid communication with the barrel bore; a suppressor mounting adapter at least partially surrounding and removably coupled to the barrel insert, the mounting adapter comprising an upper through passage receiving the barrel insert at least partially therein and a lower through passage; the upper through passage defining an annular gas expansion chamber formed between the barrel insert and the mounting adapter; the mounting adapter further comprising a rear end abuttingly engaging the front end of the receiver, and an internal first annular protrusion engaging and compressing an annular flange on the barrel insert against the front end of the receiver; a muzzle cap threadably engaging the front end of the barrel insert and having a rear end abuttingly engaging an internal second annular protrusion of the mounting adapter to secure the mounting adapter to the receiver; the mounting adapter being configured for mounting a baffle assembly to the firearm; wherein when the handgun is discharged, the annular gas expansion chamber fills with combustion gas vented from the gas ports of the barrel insert.

In another aspect, a method for converting an unsuppressed firearm to an integrally suppressed firearm comprises: providing a firearm having a first unsuppressed configuration with no muzzle blast reduction provisions, the unsuppressed firearm including a frame, a receiver supported by the frame, a barrel insert attached to the receiver, and a barrel shroud at least partially surrounding the barrel insert; removing the barrel shroud from the barrel insert; sliding a suppressor mounting adapter over the barrel insert; securing the mounting adapter to the barrel insert; and coupling a baffle assembly comprising a plurality of sound suppression baffles to the mounting adapter; wherein the firearm has a second suppressed configuration operable to reduce muzzle blast.

BRIEF DESCRIPTION OF THE DRAWINGS

The features of the exemplary embodiments will be described with reference to the following drawings where like elements are labeled similarly, and in which:

All drawings are schematic and not necessarily to scale. Parts shown and/or given a reference numerical designation in one figure may be considered to be the same parts where they appear in other figures without a numerical designation for brevity unless specifically labeled with a different part number and described herein. References herein to a whole figure number (e.g. FIG. 1) shall be construed to be a reference to all subpart figures in the group of figures associated with that number (e.g. FIGS. 1A, 1B, etc.), unless indicated otherwise.

DESCRIPTION OF EMBODIMENTS

Figure 1:
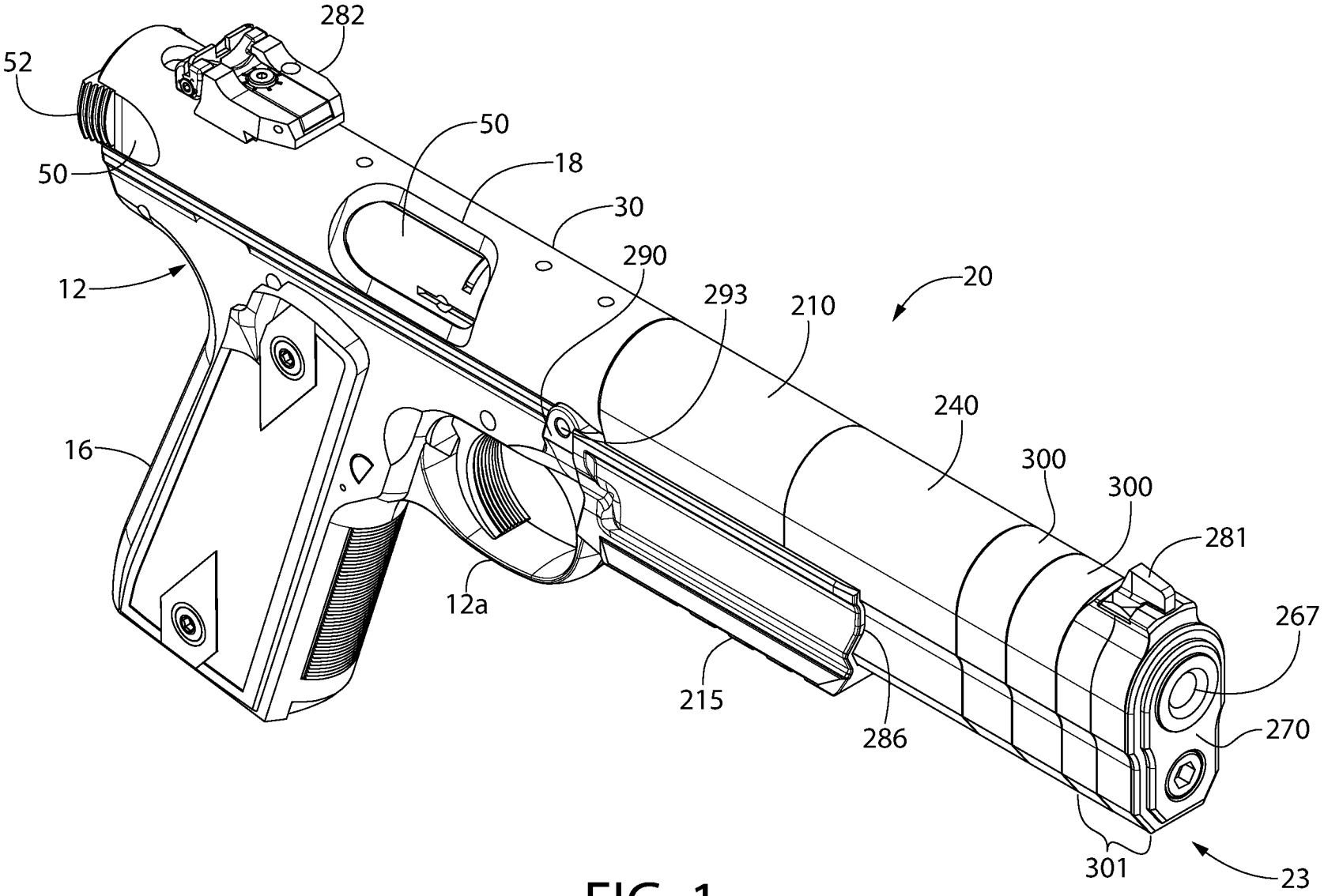
FIG. 1 is a top perspective view of an integrally suppressed pistol according to the present disclosure.

The features and benefits of the invention are illustrated and described herein by reference to exemplary (i.e. "example") embodiments. This description of exemplary embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," and "interconnected," refer to a relationship wherein structures are secured or attached to one another either directly or indirectly through intervening structures, as well as both movable or rigid attachments or relationships, unless expressly described otherwise. Accordingly, the disclosure expressly should not be limited to such exemplary embodiments illustrating some possible non-limiting combination of features that may exist alone or in other combinations of features.

FIGS. 1-11 depict a non-limiting representative example of an integrally suppressed firearm according to the present disclosure. The firearm may be handgun such as a pistol 10 in one embodiment as shown; however, in other embodiments the integrally suppressed handgun may be a revolver. In yet other embodiments, the suppressor assembly may be adapted for use in long guns including without limitation shotguns, rifles, and carbines. Accordingly, the invention is not limited in its application to any particular type of firearm.

Pistol 10 defines a longitudinal axis LA and includes a grip frame 12 having a front trigger guard portion 12*a* and a barrel-receiver assembly 20/30 supported by the grip frame. The barrel-receiver assembly includes barrel assembly 20 coupled to and supported by receiver 30. The rear of the frame 12 defines a vertically elongated grip 16 for holding pistol 10. The frame 12 includes an at least partially open interior space 11 extending longitudinally and vertically for housing the firing mechanism components (see, e.g. FIGS. 8-10). A portion of interior space 11 in grip 16 further defines a magazine well 13 configured to hold a removably insertable magazine 15 that holds a plurality of cartridges. Frame 12 may be made of any suitable material commonly used in the art including metal, polymer (e.g. glass reinforced or unreinforced nylon or other plastic), wood, composites, or combinations thereof.

Receiver 30 may be an axially elongated and generally hollow cylindrical structure defining a longitudinally-extending internal cavity 38. Other receiver configurations may be used and are not limiting of the invention. Receiver 30 is fixedly mounted to the grip frame 12 and does not move relative thereto when firing the pistol 10. Receiver 30 includes an open front end 31, opposing open rear end 33, and an ejection port 18 (see FIGS. 1-2). Cavity 38 may be generally circular in cross section and may vary in diameter along the length of the receiver. Cavity 38 may extend axially completely through receiver 30 and communicate with open front and rear ends 31, 33 as shown. Open front end 31 of receiver 30 communicates with chamber 28 of a barrel insert 60 of the barrel assembly 20 to load cartridges from magazine 15 (disposed in the downwardly open magazine well 13 of the grip frame 12) into the chamber, and to extract spent cartridges from the chamber for ejection through ejection port 18 of the receiver. Open rear end 33 allows the rear portion of reciprocating bolt 50 to alternatively project outwards and rearwards from the receiver 30 under recoil, and return at least partially back inside the receiver in a sliding axial motion. Receiver 30 further includes a bottom cartridge feed opening that communicates with the magazine well for receiving cartridges from the magazine. In one embodiment, a rear sight 282 may be mounted to the receiver 30.

With particular reference to FIGS. 8-11, barrel assembly 20 includes an open front end 23 and an open rear breech end 25. The rear breech end of barrel assembly 20 defines a chamber 28 configured for holding an ammunition shell or cartridge. Chamber 28 is configured to properly support the cartridge casing during firing of the pistol 10. In one non-limiting embodiment, the chamber 28 may be configured for holding rimfire type cartridges; however, in certain other embodiments the chamber may be configured for centerfire type cartridges. Both type cartridges are well known to those skilled in the art without further elaboration. Barrel assembly 20 is axially elongated and defines a longitudinally-extending projectile pathway P through which a slug or bullet explosively released from the cartridge may travel. Pathway P communicates with open ends 23, 25 of the barrel assembly 20.

Barrel assembly 20 includes a rear firing portion configured to hold a cartridge and coupled to receiver 30, and a front suppressor portion removably coupled thereto and configured to deaden the muzzle blast or noise associated with firing the pistol 10. Referring to FIGS. 8-11 and 22, the rear firing portion includes barrel insert 60 which may be fixedly mounted to the receiver in axial position. When firing pistol 10, the barrel insert 60 therefore does not move relative to the receiver 30 or grip frame 12 (i.e. remains stationary). Barrel insert 60 has an axially elongated cylindrical body including an open front muzzle end 61 and a rear that defines the rear breech end 25 of the barrel assembly 20 and cartridge chamber 28 therein (previously described). A longitudinally-extending bore 62 extends between the ends to define a portion of projectile pathway P. Longitudinal axis LA is defined by and is coaxial with the centerline of the bore. A transverse or lateral direction or orientation is defined as being perpendicularly or obliquely angled to the longitudinal axis for convenience of description. The rear end of barrel insert 60 may include an inclined cartridge feed ramp 59 to facilitate smoothly loading cartridges from the magazine into the chamber 28. In some embodiment, barrel insert 60 has a relatively short axial length in contrast to the front suppressor portion. Accordingly, barrel insert 60 may have a length which is less than the combined length of the suppressor portion measured from the rear end 113 of suppressor mounting adapter 210 to the front of front end cap 270 that defines the front end 23 of the barrel assembly as measured along the longitudinal axis LA (see, e.g. FIG. 8 long suppressor configuration and FIG. 20B short suppressor configuration).

Figure 9:
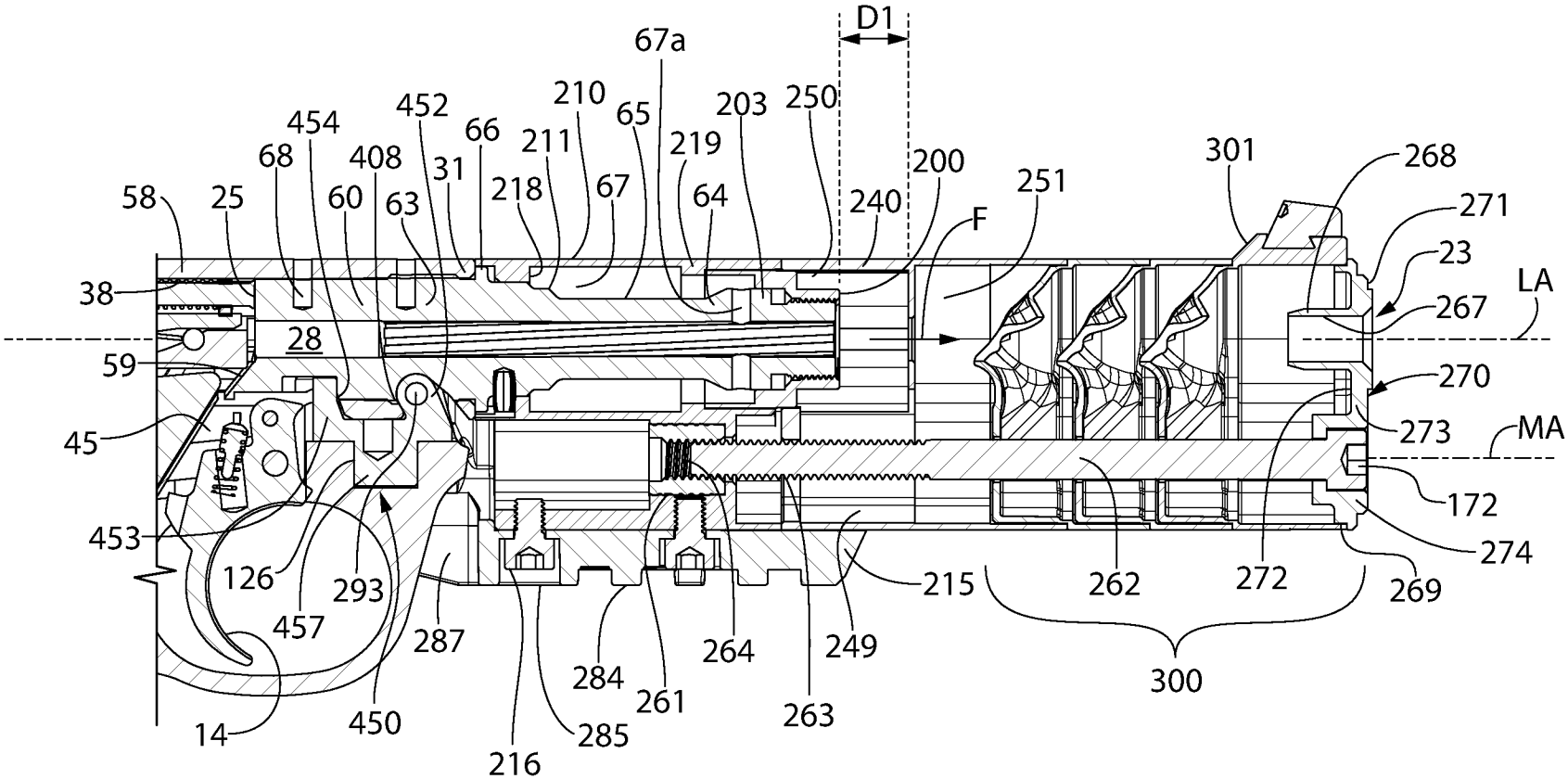
FIG. 9 is a detailed cross-sectional view taken from FIG. 8.
Figure 10:
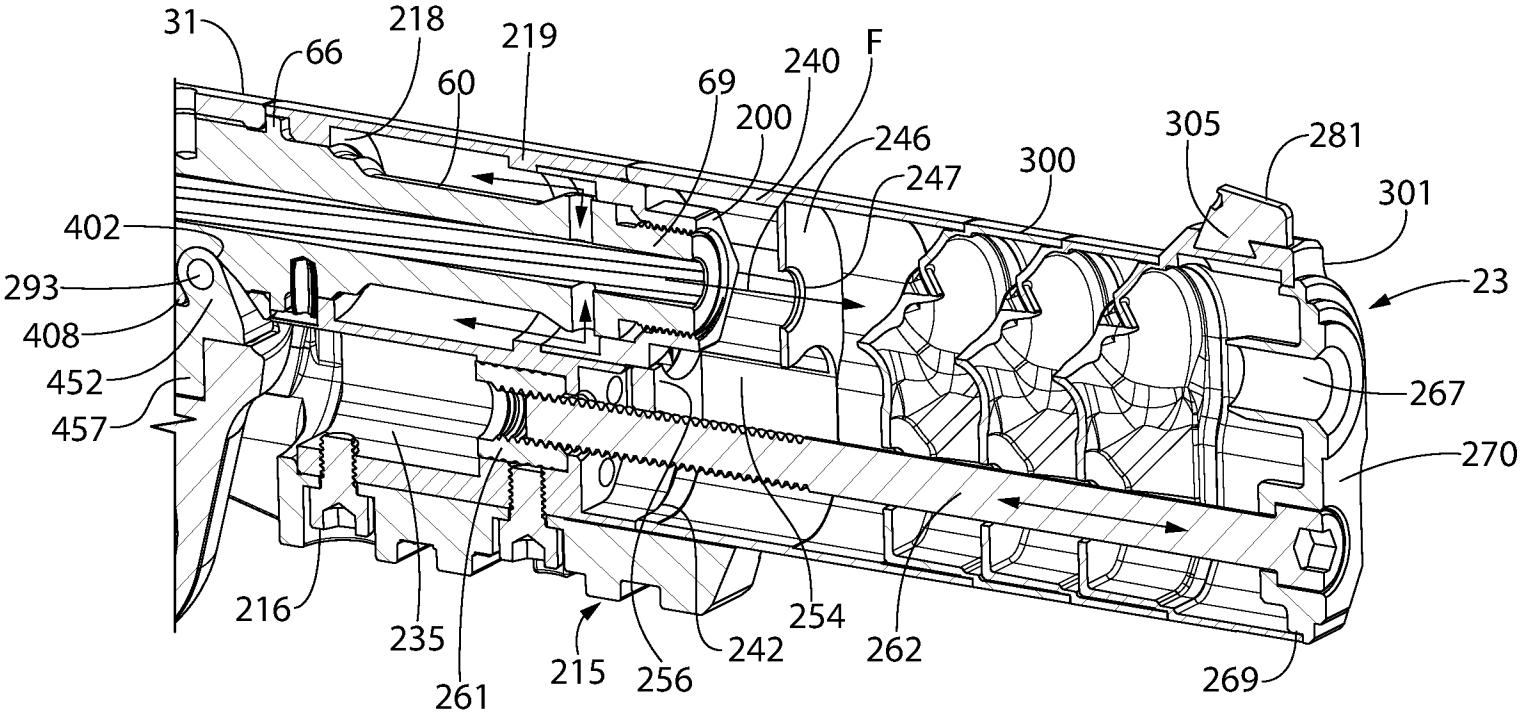
FIG. 10 is a perspective cross-sectional view thereof.

Barrel insert 60 further includes a full diameter rearward mounting portion 63, a forward retention portion 64, and an intermediate portion 65 extending therebetween. Mounting portion 63 is configured for insertion through the open front end 31 of receiver 30 into its internal cavity 38, as best shown in FIGS. 9 and 10. The cylindrically-shaped mounting portion 63 thus has an outside diameter which is preferably just slightly smaller than an inside diameter of the circular forward portion of the receiver cavity 38 for reception therein. Mounting portion 63 of barrel insert 60 may be fixedly mounted to the receiver by at least one, but preferably two fastening members 68. For a more permanent fixation, the fastening members 68 may be pins driven through concentrically aligned holes formed in the receiver 30 and barrel insert 60 as in the illustrated embodiment. This locks the barrel insert 60 to the receiver and in axial position in either case. For a removable fixation of barrel insert 60 to receiver 30, fastening members 68 may be threaded fasteners received in threaded sockets formed in the barrel insert 60. The threaded fasteners extend through holes in the receiver concentrically aligned with the threaded sockets. This allows barrel insert 60 to be easily detached from the receiver for replacement or maintenance if needed.

With continuing reference to FIGS. 8-11 and 22, an outwardly protruding annular flange 66 formed on mounting portion 63 of barrel insert 60 abuttingly engages the front face or end 31 of the receiver when the mounting portion 63 is inserted into the receiver cavity 38. Flange 66 serves two purposes. First, flange 66 ensures that the rear breech end 25 of the barrel resides in the proper location inside the receiver 30 with respect to the breech face 53 of the bolt 50 and magazine well 13 for forming a closed breech and chambering cartridges from magazine 15. Second, the annular flange 66 provides an alternate or secondary means for removably locking the barrel insert 60 to the receiver 30 in the event that a removable fixation of the barrel insert to receiver using threaded fastening members 68 is used as described above.

Forward retention portion 64 of barrel insert 60 is configured to mount the front suppressor portion of barrel assembly 20 to the pistol 10. The forward retention portion is positioned at least partially inside suppressor mounting adapter 210 and may have a diameter smaller than the rear mounting portion 63 of barrel insert 60 (see, e.g. FIG. 9). Forward retention portion 64 includes a forwardly projecting threaded extension 69 of reduced diameter which defines the terminal front muzzle end 61 of the barrel insert 60 that receives an internally threaded muzzle cap 200 thereon.

Figure 38:
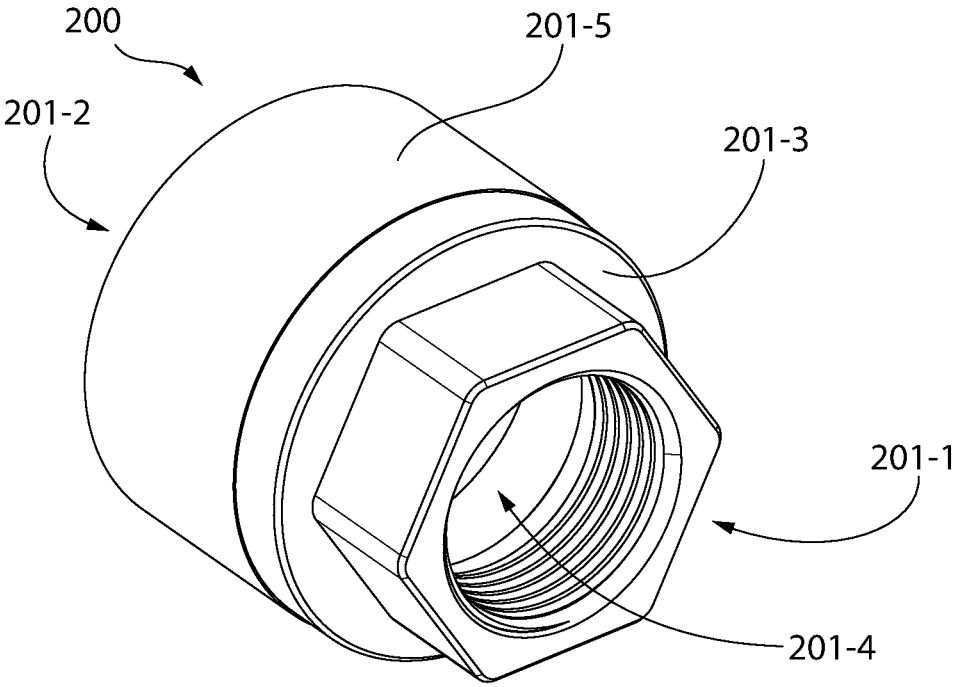
FIG. 38 is a front perspective view of the muzzle cap seen in FIG. 9 et al.
Figure 39:
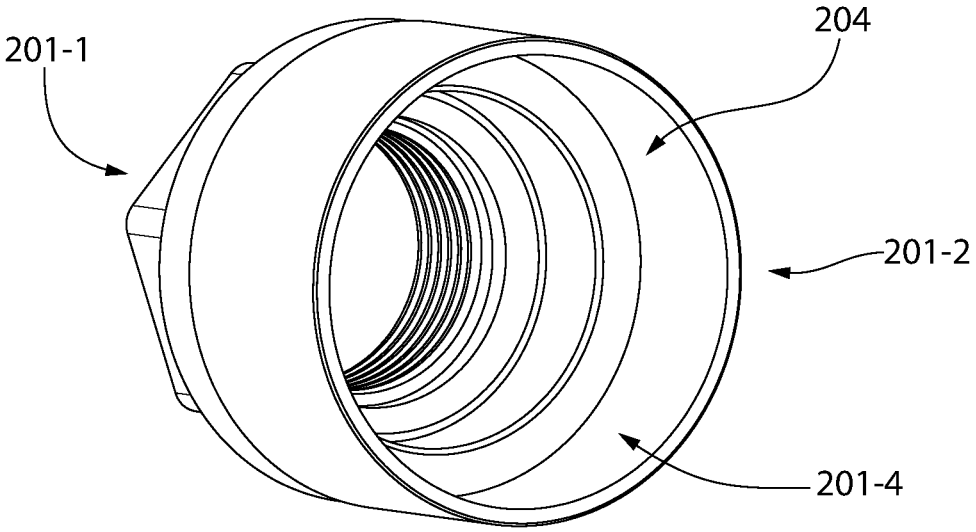
FIG. 39 is a rear perspective view thereof.
Figure 40:
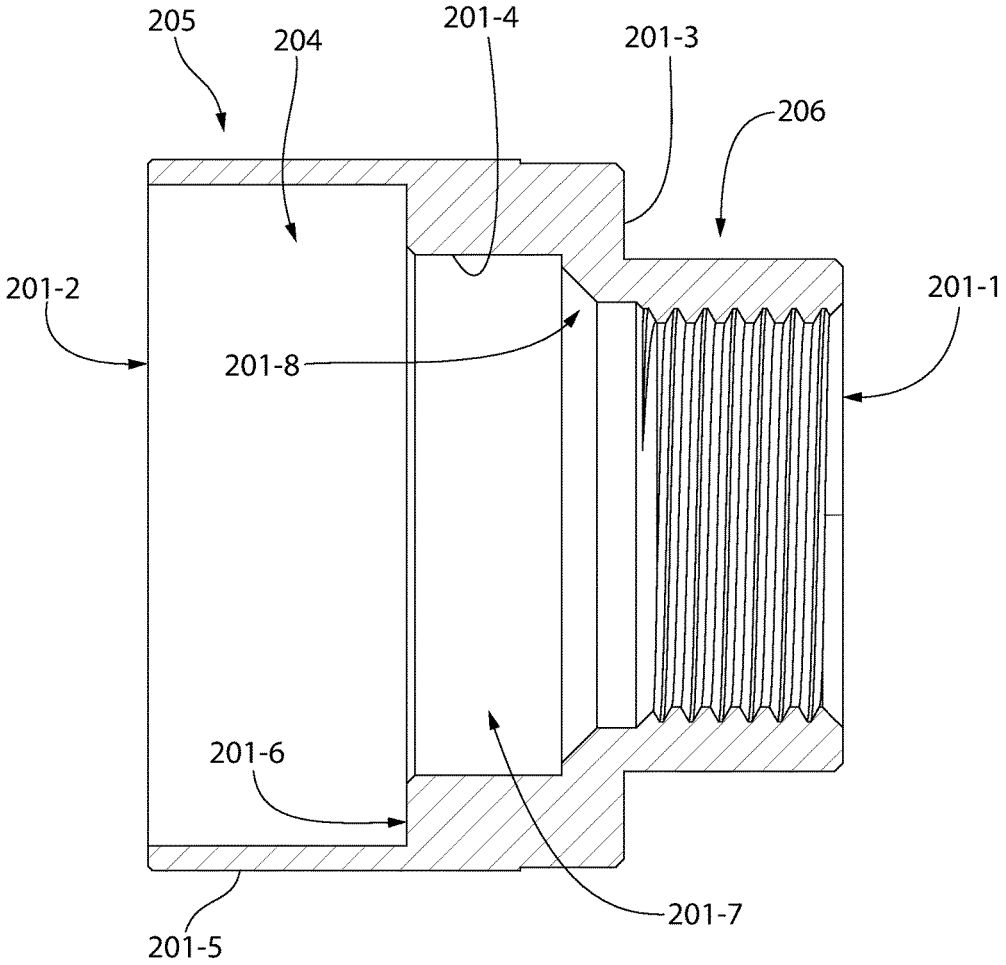
FIG. 40 is a side transverse cross-sectional view thereof.

Muzzle cap 200 may be generally configured as a modified lock nut with some notable and distinct gas flow related features. FIGS. 38-40 show muzzle cap 200 in isolation and greater detail. Muzzle cap 200 includes a front tooling portion 206 defining an open front end 201-1, a rear shield portion 205 defining a rear end 201-2, and an axial through passage 201-4 extending therebetween which receives a portion of the barrel insert forward retention portion 64 with threaded extension 60 of barrel insert 60 (best shown in FIGS. 9 and 10). The annular rear end 201-2 of muzzle cap 200 engages mounting adapter 210 at an inwardly extending front annular protrusion 219 of the adapter to retain the adapter to the barrel insert 60. An annular shoulder 203, stepped in configuration, is formed between the threaded extension 69 and diametrically larger retention portion 64 of barrel insert 60. The retention portion 64 has an exterior diameter larger than the threaded extension 60. Muzzle cap 200 therefore cannot be threaded onto extension 69 past shoulder 203. In some implementations, shoulder 203 may be engaged by muzzle cap 200 when the integrally suppressed barrel assembly 20 is mounted to pistol 10, but this is not necessary to retain the front suppressor portion of barrel assembly 20 to the firearm as shown in the illustrated embodiment due to engagement between muzzle cap 200 and the mounting adapter 210 as further described herein.

Referring to FIGS. 9, 10, and 38-40, the rear shield portion 205 of muzzle cap 200 adjacent to rear end 201-2 may be larger in transverse cross section (diametrically) than the front tooling portion 206 of the muzzle cap adjacent to front end 201-1 thereby defining a stepped annular shoulder 201-3 therebetween. The smaller front tooling portion 206 may have a polygonal tooling configuration such as a hex nut shape for engaging a hex tool) used to rotate and threadably engage the muzzle cap with the threaded extension 69 of the barrel insert 60. Other tooling shapes and tools may be used. The front portion of muzzle cap 200 contains internal threads configured to engage the external threads of the barrel insert front threaded extension 69.

The larger rear shield portion 205 of muzzle cap 200 may comprise a cylindrical sidewall 201-5 which defines a rearwardly open internal gas inlet chamber 204 which receives combustion gas vented by radial gas ports 67*a* formed in barrel insert 60 (see, e.g. FIGS. 9 and 10). Sidewall 201-5 defines a gas shield to prevent the gas jetting from barrel insert gas ports 67*a* from impinging directly on the interior of the mounting adapter 210 within its gas expansion chamber 67. Gas inlet chamber 204 is formed by a rear portion of the axial through passage 201-4 of muzzle cap 200 and assumes an annular shape formed between the barrel insert 60 and cylindrical sidewall 201-5 of the muzzle cap when mounted to the barrel insert 60 of the firearm (see, e.g. FIGS. 9 and 10). When the firearm is fired, combustion gas from barrel insert ports 67*a* enters inlet chamber 204 radially in a direction perpendicular to longitudinal axis LA in one configuration. The gas then flows rearward in a longitudinal (axial) direction from the gas inlet chamber 204 out through open rear end 201-2 into the adjacent larger volume gas expansion chamber 67 within the mounting adapter 210. The muzzle cap 200 in contrast to the mounting adapter 210 is a less complex and therefore less expensive replacement part. The muzzle cap 200, which preferably is made of steel, experiences and there is well suited for exposure to the initial highly erosive impingement wear caused by the high velocity gas jets vented from the barrel insert ports 67*a* (i.e. flame cutting). Advantageously, this allows the mounting adapter 210 in some possible embodiments to made of a less hard and lighter material such as aluminum for weight reduction because the muzzle cap experiences the initial high pressure direct blast of gas jetting into the gas inlet chamber 204 of the cap from the lateral exhaust gas ports 67*a* of the barrel insert 60.

An internal middle transitional chamber 201-7 may be formed between the rear gas inlet chamber 204 and forward part of the through passage 201-4 inside the tooling front portion 206 of the muzzle cap 200. Transitional chamber 201-7 may have a diameter falling between the larger diameter of adjacent gas inlet chamber 204 and smaller diameter of the adjacent forward part of the through passage inside the tooling end as shown. This forms a pair of axially spaced shoulders 201-6 and 201-8 at the rear and front of the transitional chamber (best shown in FIG. 40). Transitional chamber 201-7 receives part of the front portion 64 of barrel insert 60 therein as shown in FIGS. 9 and 10, whereas the forward part of the through passage 201-4 threadably receives the front threaded extension 69 of the barrel insert. The transitional chamber 201-7 has a diameter just slightly larger than the external diameter of the barrel insert front portion 64 as shown to create resistance to gas attempting to flow forward from the exhaust gas ports 67*a* of the barrel insert which empty into the gas inlet chamber 204 of the muzzle cap 200.

Referring to FIGS. 9 and 10, the intermediate portion 65 of barrel insert 60 may have a reduced diameter in comparison to both the adjoining rearward mounting portion 63 and forward retention portion 64 in one embodiment. This creates a larger annular gap or space (i.e. volume) between the walls of the suppressor mounting adapter 210 and barrel insert 60, thereby forming an additional annular gas expansion chamber 67 within the upper through passage 115 of the mounting adapter besides those formed by the sound suppression baffles for improved sound suppression performance. Gas expansion chamber 67 is in fluid communication with combustion gases from the bore 62 of barrel insert 60 via the plurality of radial gas ports 67*a* formed in the barrel insert. In one embodiment, gas ports 67*a* may be formed in the diametrically enlarged forward retention portion 64. In other embodiments, however, the gas ports 67*a* may alternatively be formed in intermediate portion 65 of the barrel insert 60. At least two diametrically opposed gas ports 67*a* are preferably provided, however, other embodiments may have four diametrically opposed ports or more. The diametric opposed pair or pairs of gas ports balances the reactive thrust forces created by the venting gas jets and keep the barrel aligned downfield towards the target.

In operation with reference to FIGS. 9-10, when pistol 10 is fired, a small portion of the combustion gas following the projectile down the barrel bore is diverted and vented radially through gas ports 67*a* of barrel insert 60 transversely into gas inlet chamber 204 of muzzle cap 200, and then axially rearward into gas expansion chamber 67 (see directional gas flow arrows F). This may be considered to represent a bypass gas flow stream because the majority portion of the combustion gas flows axially forward along the longitudinal axis LA and exits the barrel insert 60 into the blast baffle, and then forward to the primary baffles 300. The diverted bypass gas fills the gas expansion chamber 67 to its maximum volume since there is no other gas outlet from the expansion chamber. The bypass gas then reverses direction and flows forward in chamber 67 and back through the radial gas ports 67*a* in an opposite direction and back into the barrel bore. The existing projectile and main gas flow through the barrel bore creates a vacuum (negative pressure) behind it which helps draw the bypass gas back into the barrel bore (see, e.g. gas flow arrows in FIG. 10). Advantageously, the additional gas expansion volume provided by the gas expansion chamber 67 of the suppressor mounting adapter 210 and temporary bypass gas flow delay time improves sound suppression performance by allowing for some degree of partial gas expansion before the bypass gas eventually re-enters the barrel bore and flows forward into the baffle assembly with the main gas flow. The gas flow originating from the gas expansion chamber 67 may thus be considered a gas bypass flow or stream extracted from the barrel insert 60 upstream of the baffles.

Figure 8:
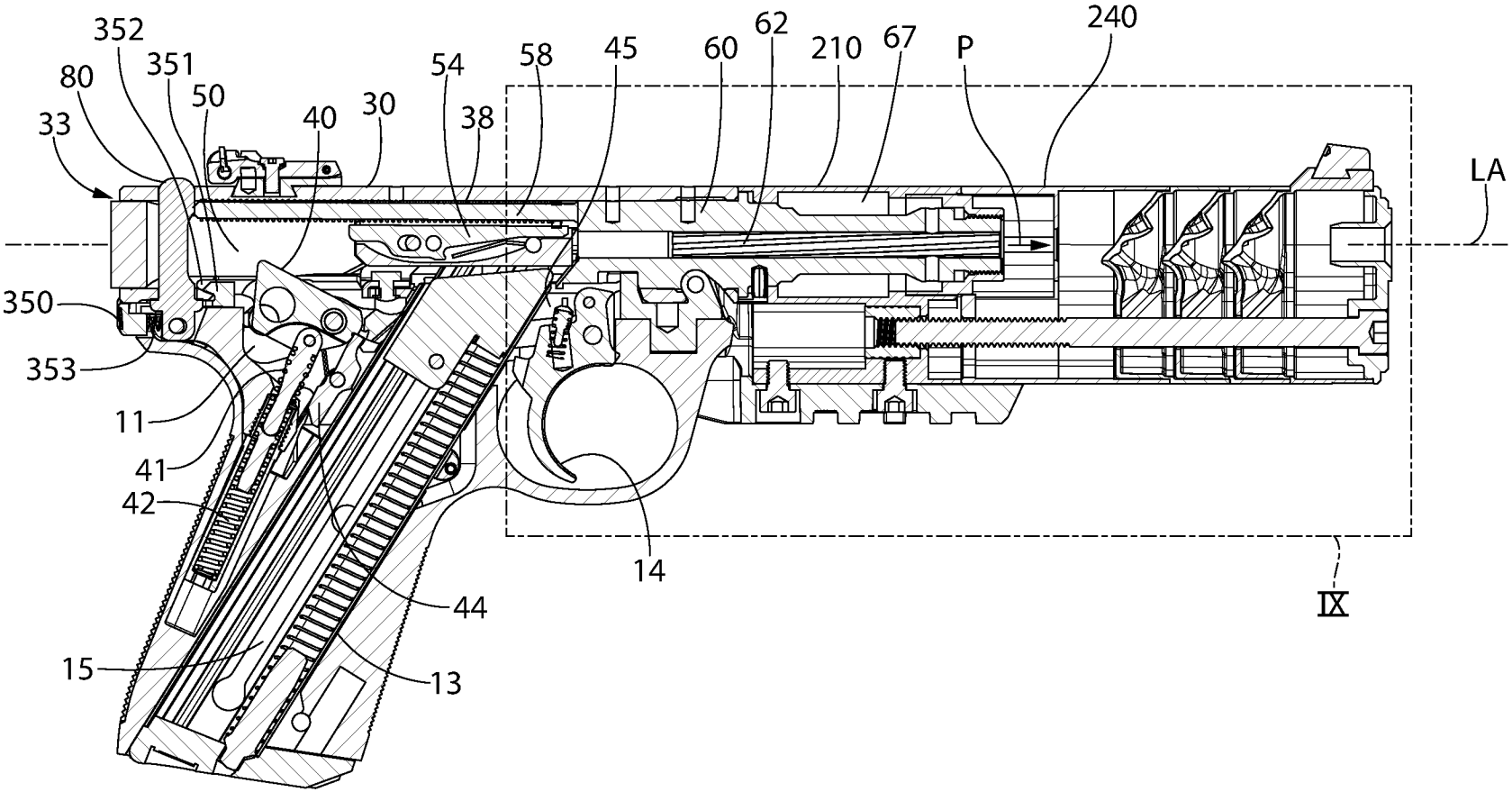
FIG. 8 is a right side cross-sectional view thereof.

As seen in the non-limiting embodiment shown in FIGS. 8-10, although barrel insert 60 is ported, there is no direct passageway for combustion gas to atmosphere from the barrel insert or mounting adapter 210 unlike unsuppressed pistols having ported barrels which exhaust the gas directly to atmosphere. Instead, the diverted portion of the gas (i.e. the bypass gas discussed above) is contained within and momentarily delayed within the suppressor mounting adapter 210 until re-entering the barrel bore and flowing forward through the entire stack of sound suppression baffles. Accordingly, the present embodiment is distinguishable from ordinary ported barrel designs which are merely vented directly to atmosphere with no gas delay or sound suppression benefits.

In one embodiment, the entirety of the portion of barrel insert 60 forward of the rear mounting portion 63 disposed inside receiver 30 is completely enclosed by the suppressor mounting adapter 210 (excluding the threaded front mounting extension 69 engaged by muzzle cap 200). In one embodiment, the entire intermediate portion 65 of barrel insert 60 may be located inside the adapter 210. In one embodiment, frustoconical transition sections 211 may be provided to form a smooth transition between the smaller diameter intermediate portion 65 and the larger diameter rear mounting and front retention portions 63, 64 of the insert 60 for aesthetic considerations. The reduced diameter intermediate portion 65 beneficially reduces the weight of the pistol in addition to providing added volume for the gas expansion chamber 67 of the mounting adapter 210.

Figure 2:
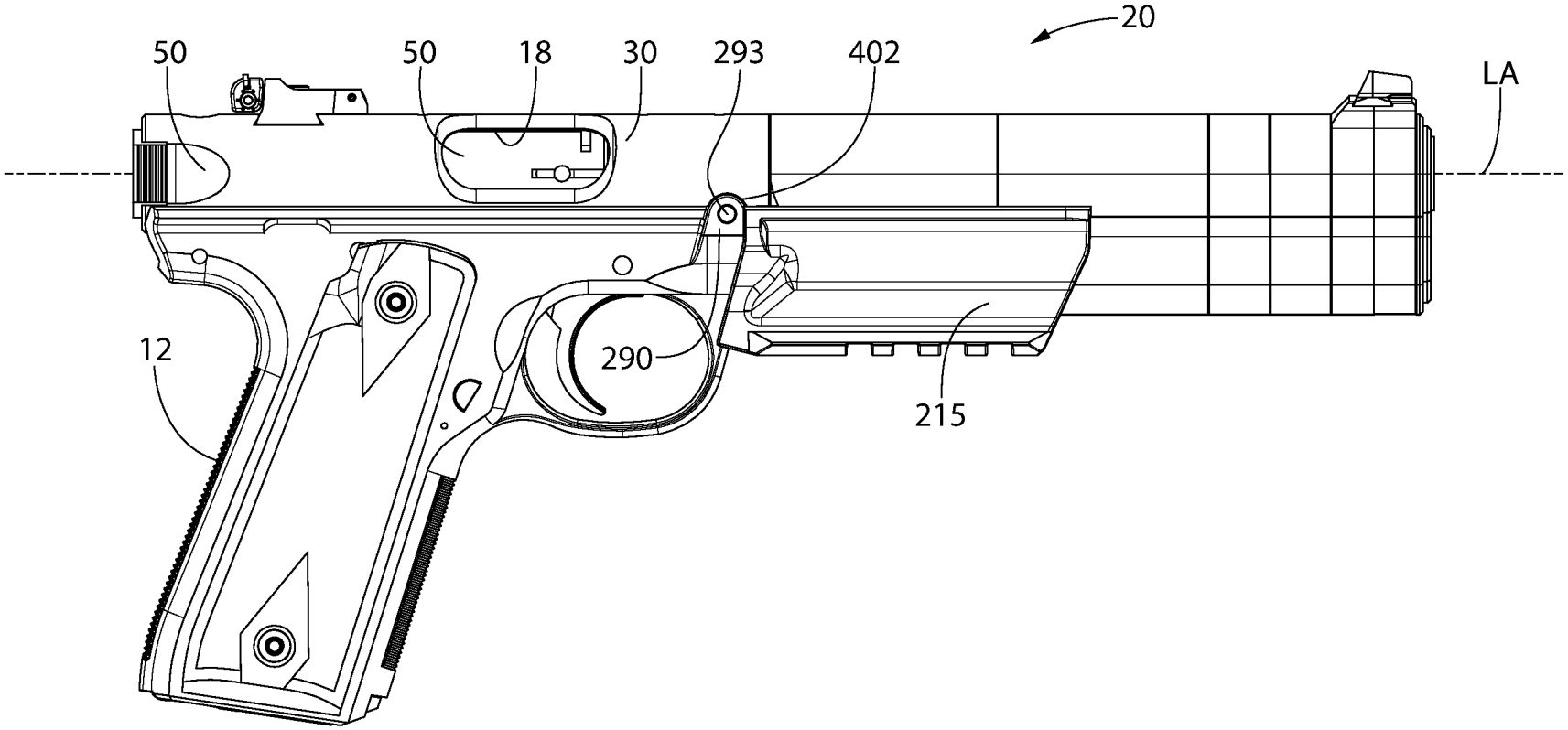
FIG. 2 is a right side elevation view thereof.
Figure 3:
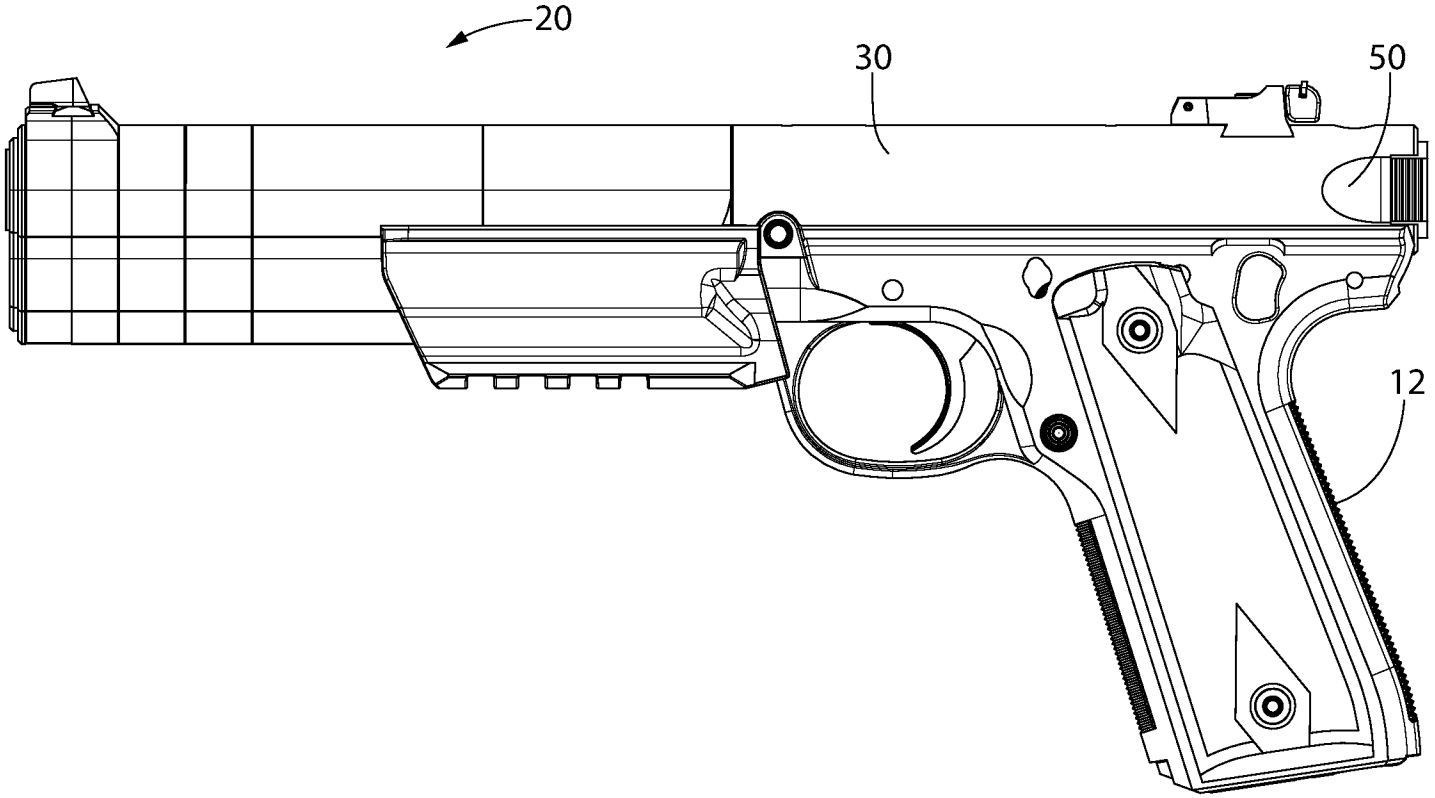
FIG. 3 is a left side elevation view thereof.
Figure 4:
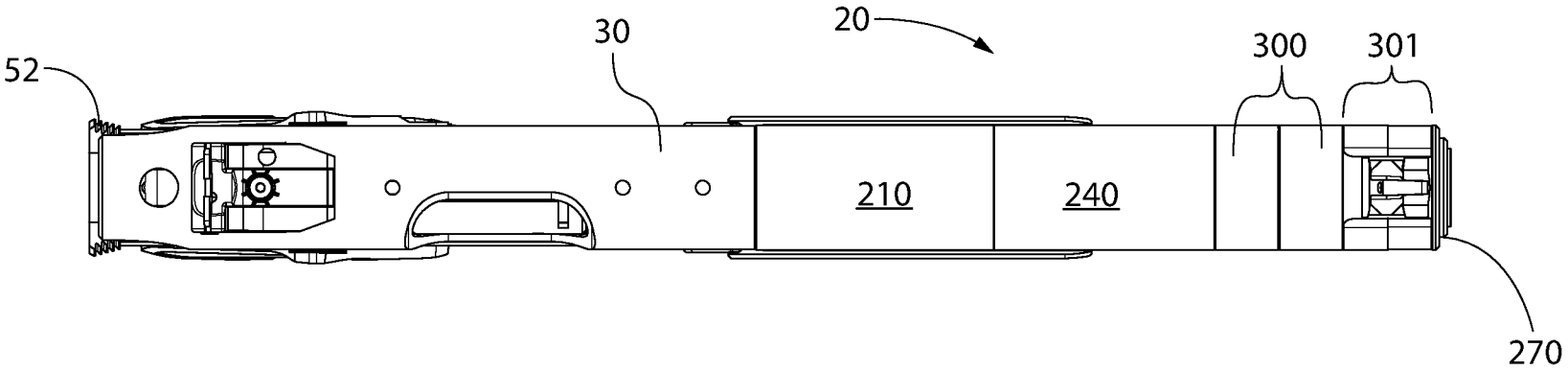
FIG. 4 is a top view thereof.
Figure 5:
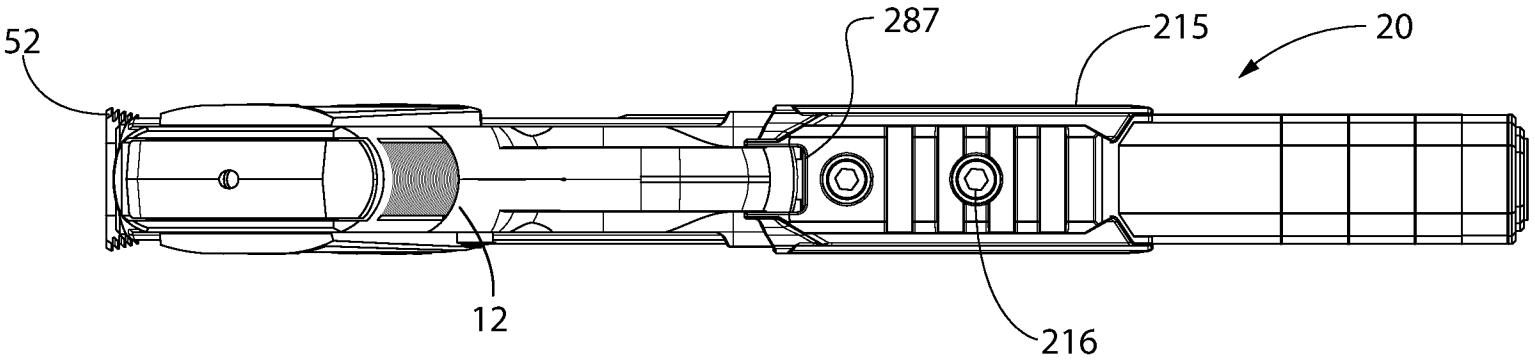
FIG. 5 is a bottom view thereof.
Figure 6:
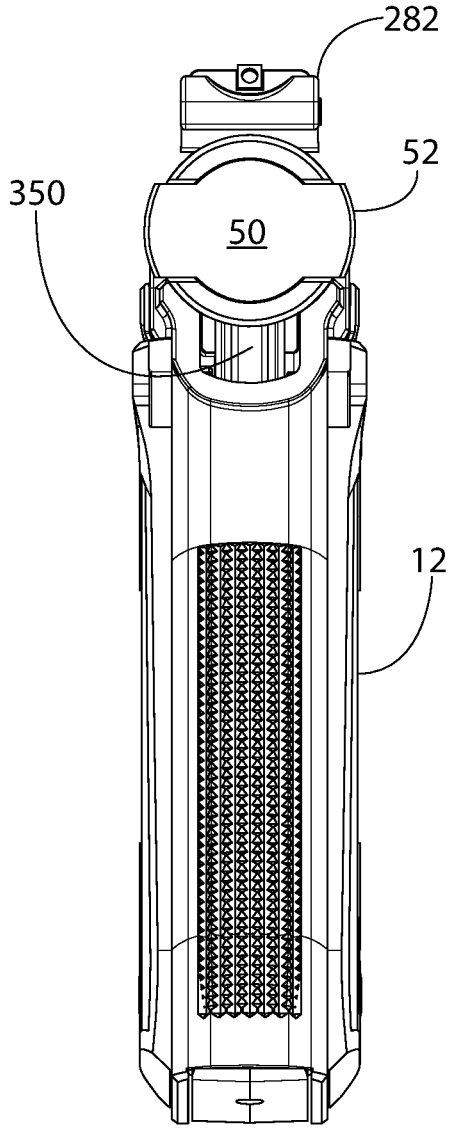
FIG. 6 is a rear view thereof.
Figure 7:
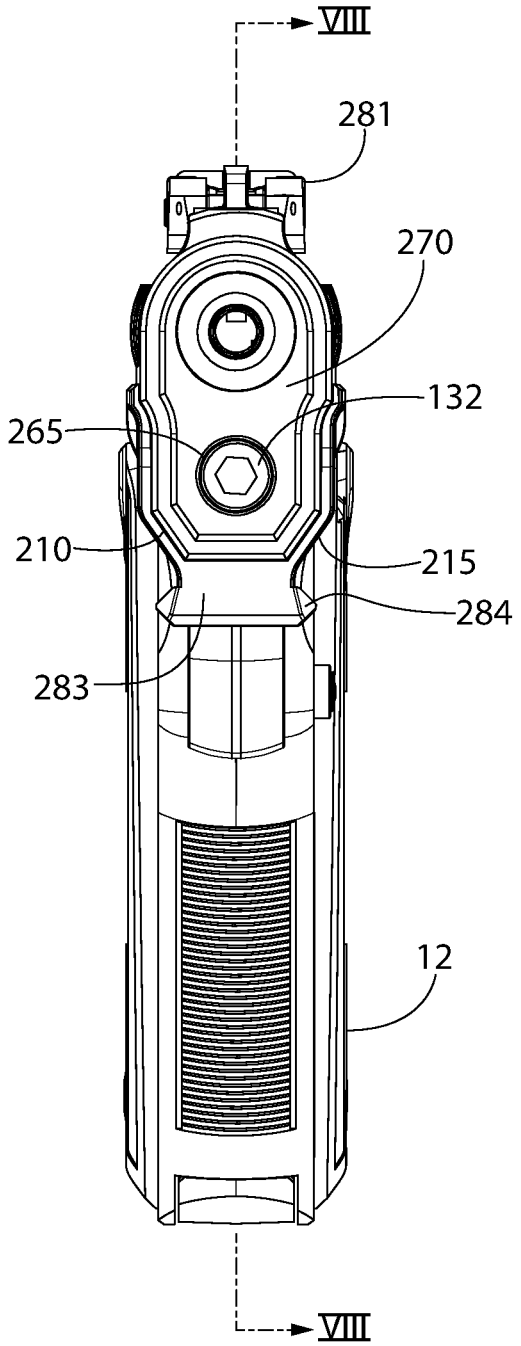
FIG. 7 is a front view thereof.
Figure 22:
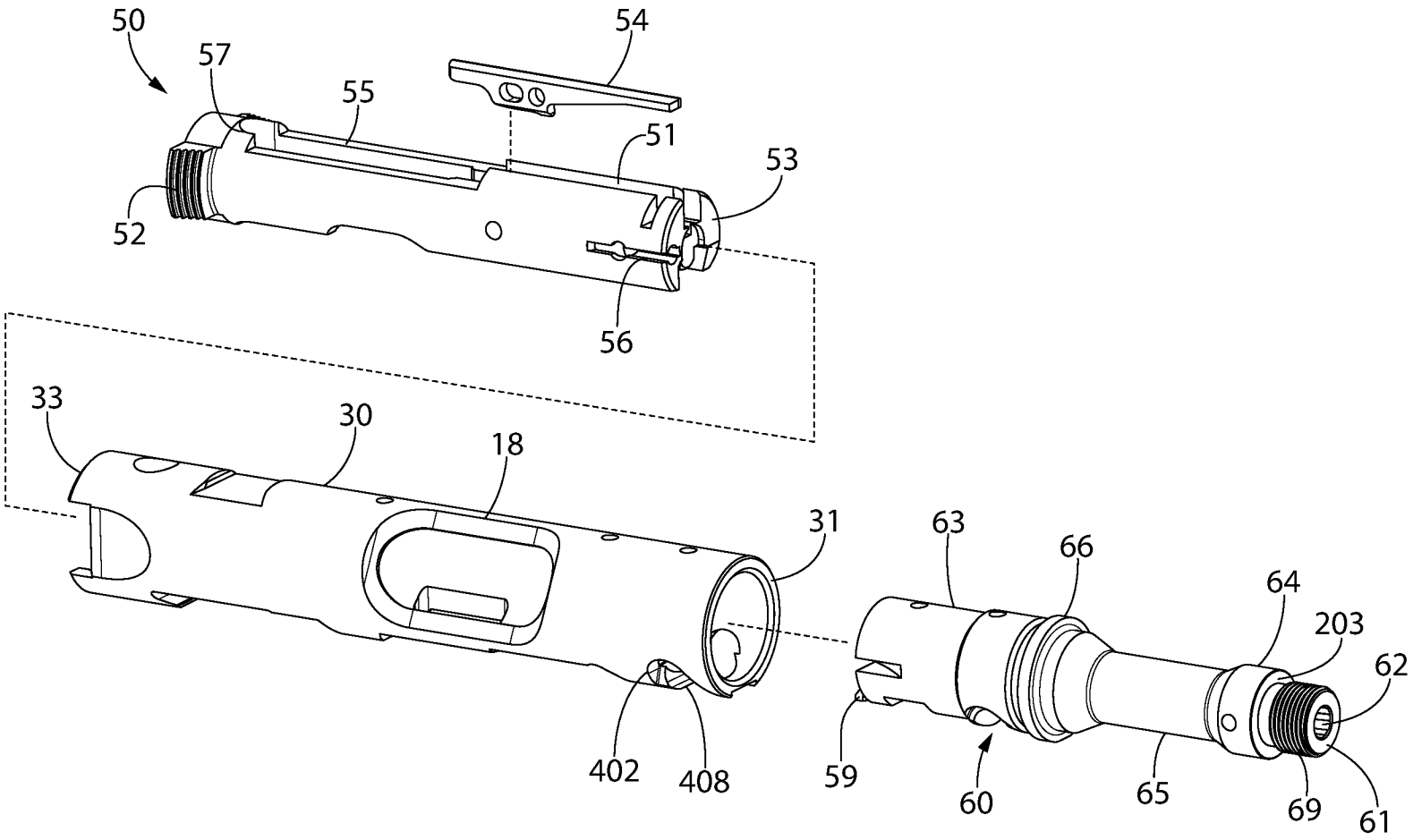
FIG. 22 is an exploded view of the barrel-receiver assembly.

Referring now to FIGS. 1-11 and 22, the spring-biased reciprocating bolt 50 may include opposing laterally projecting bolt ears 52 at the rear for manually retracting the bolt (see, e.g. FIGS. 1-2). Bolt 50 is axially elongated and generally cylindrical in shape as best shown in FIG. 22. Bolt 50 is slideably mounted inside receiver 30 within cavity 38 for rearward and forward reciprocating movement in recoil upon discharging the pistol, or when manually retracting the bolt. The forward face of the bolt 50 defines the breech face 53 arranged to engage the rear end of a chamber 28 of the barrel assembly that holds the ammunition cartridge. The bolt 50 is movable between a forward closed breech position in which the breech face 53 is in battery with the chamber 28, and rearward open breech position distanced from and disengaged from chamber. Bolt 50 is biased towards the closed breech position by a recoil spring 58. In one embodiment, bolt 50 further includes an axially elongated slot 55 through which an upright bolt stop pin 80 fixedly mounted to grip frame 12. This slot allows the bolt 50 to slide around and past the bolt stop pin 80 both forward/rearward during recoil or when manually opening the breech. The rear end of the slot 57 may be arcuately curved and serves as a bolt stop to limit the forward movement and position of the bolt 50 when the breech is closed. A portion of the slot 55 defines the hammer slot which allows the hammer to reach and strike the rear end of the firing pin 54. Bolt 50 may be made of any suitable material for the service conditions. In some embodiments, bolt 50 may be made of steel or an alloy thereof suitable for withstanding the combustion forces generated when detonating a cartridge while maintain a closed breech thereby supporting the rim area of the cartridge.

Referring to FIGS. 8-10 and 22, bolt 50 carries and includes a linearly movable firing pin 54 for striking a chambered cartridge. Bolt 50 may further include a cartridge extractor (not shown) disposed in an elongated slot 56 at a forward end of the bolt body for extracting a spent shell or casing from chamber 28 after firing, in a manner well known in the art. Firing pin 54 has an axially elongated body movably disposed in a firing pin slot 51 formed in the bolt body. Bolt 50 includes an axially elongated hammer slot which allows a pivotable hammer (not shown) of the firing mechanism to strike the rear end of the firing pin. This drives the firing pin forward to strike the chambered cartridge. In one configuration as shown herein, the front end of the firing pin 54 may be offset from the longitudinal axis LA of the pistol. This placement positions the firing pin 54 to strike the annular peripheral rim of a chambered rimfire type cartridge to detonate the round. In other embodiments of a centerfire pistol, the front end of the firing pin may be coaxial with the longitudinal axis LA for striking the centered percussion cap of a chambered centerfire type cartridge.

In one non-limiting embodiment, barrel-receiver assembly 20/30 may be mounted in a pivotable and tilting manner to grip frame 12 via a suitable rotational coupling. Commonly owned U.S. Pat. No. 9,791,223, which is incorporated herein by reference, discloses a pivotable mounting systems for use with the present pistol 10. The barrel-receiver assembly 20/30 is angularly movable between a closed operating (i.e. ready-to-fire) position (see, e.g. FIG. 1) and an open position (see, e.g. FIG. 20). In the closed position, the barrel-receiver assembly 20/30 is coaxially aligned with the longitudinal axis LA of pistol 10. In the open position, the barrel-receiver assembly 20/30 is disposed at an oblique angle to the longitudinal axis LA for maintenance.

With additional reference to FIGS. 1-3 and 8-11, in one embodiment the barrel-receiver assembly 20/30 may be pivotably mounted to grip frame 12 by cross pin 293 extending transversely through a lower front portion of the receiver 30 and pair of laterally spaced apart mounting stands or protrusions 290 extending upwards from the grip frame. This provides a pivot coupling in which the cross pin 293 must be removed to completely detach the barrel-receiver assembly from the grip frame 12. In an alternative embodiment, the barrel-receiver assembly may be completely removable from the frame without removing the cross pin 293. In this embodiment, the barrel-receiver assembly 20/30 includes a hooked lug 400 which may be defined by a downwardly extending hooked mounting protrusion 408 on the receiver 30 and an adjacent downwardly open mounting slot 402 located just forward of the mounting protrusion. Mounting slot 402 is elongated and obliquely angled to longitudinal axis LA of pistol 10. The mounting slot 402 may be straight or arcuately curved in some embodiments. In one implementation, slot 402 may be located at the forward part of the receiver 30 near its front end 31 as shown. The location of the slot 402 may be varied in other embodiments.

With continuing reference to FIGS. 1-3, 8-11, and 20, the oblique mounting slot 402 and hooked mounting protrusion 408 may pivotably engage cross pin 293. In an alternative embodiment, however, the slot 402 and protrusion 408 may instead engage a separate frame pivot insert 450 removably mounted to the frame by cross pin 293 driven through mounting protrusions 290, as presently illustrated. Pivot insert 450 is fully described in U.S. Pat. No. 9,791,223 previously mentioned. In general, pivot insert 450 generally comprises a main body including a front pivot protuberance 452 extending upwards from the body, a rear portion 453 extending upwards from the body and longitudinally spaced apart from the pivot protuberance, and a mounting stem 457 extending downwards from the body. Stem 457 is inserted in an upwardly open socket **12*b* formed in the grip frame 12. The space between the pivot protuberance and rear portion defines an upwardly open receptacle 454 having a complementary configuration to the downwardly extending hooked mounting protrusion 408** of the barrel-receiver assembly.

Receptacle 454 in this embodiment comprises a rear wall (defined by rear portion 453 of insert 450), a front wall (defined by pivot protuberance 452), and a flat horizontal bottom wall 461 extending therebetween. Front wall 460 may have an angled shape (with respect to bottom wall 461) to complement the angled shape of the hooked lug 400 on the front portion of barrel-receiver assembly protrusion 408. In some embodiments, pivot protuberance 452 may be obliquely angled to bottom wall 461 and longitudinal axis LA (when the insert 450 is mounted in the frame 12) providing a complementary angle to the front portion of the mounting protrusion 408 which defines the hooked lug.

In the present embodiment being described, the pivot protuberance 452 of the frame pivot insert 450 may be barrel-shaped defining a part-circular convexly curved configuration which defines a transversely elongated arcuate pivot surface 455 that engages the complementary concavely curved closed top end of barrel-receiver assembly mounting slot 402 defined by the receiver body. The mutually engaged curved surfaces of the hooked mounting protrusion 408 within slot 402 and pivot protuberance 452 provide smooth titling action of the barrel-receiver assembly 20/30 on frame 12. It bears noting that in embodiments described above in which the hooked lug 400 directly engages the cross pin 293, the arcuately curved pivot surface is defined by the pin instead of the pivot protuberance.

A latching system is provided for locking and unlocking the tilting barrel-receiver assembly 20/30 to/from grip frame 12. The latching system includes a manually-operated latch 350 slideably mounted on the rear of the grip frame beneath the receiver. Latch 350 is configured to selectively engage and disengage the barrel-receiver assembly 20/30 or an appurtenance thereof to (1) lock the pivoting barrel-receiver assembly 20/30 in the closed position to the grip frame 12 during firing operation of the pistol (see, e.g. FIGS. 1-3 and 8), and (2) to unlock the barrel-receiver assembly so that the assembly may be pivoted to the tilted open position (see, e.g. FIG. 20). Latch 350 includes rearwardly projecting hook 351 configured to engage a complementary configured locking recess 352 formed on the underside of barrel-receiver assembly 20/30 (see, e.g. FIGS. 8 and 11) to form a locked position. The latch 350 is spring biased into the rearward locked position by spring 353. Pushing the latch 350 forward to the unlocked position disengages latch hook 351 from the locking recess 352.

Figure 20:
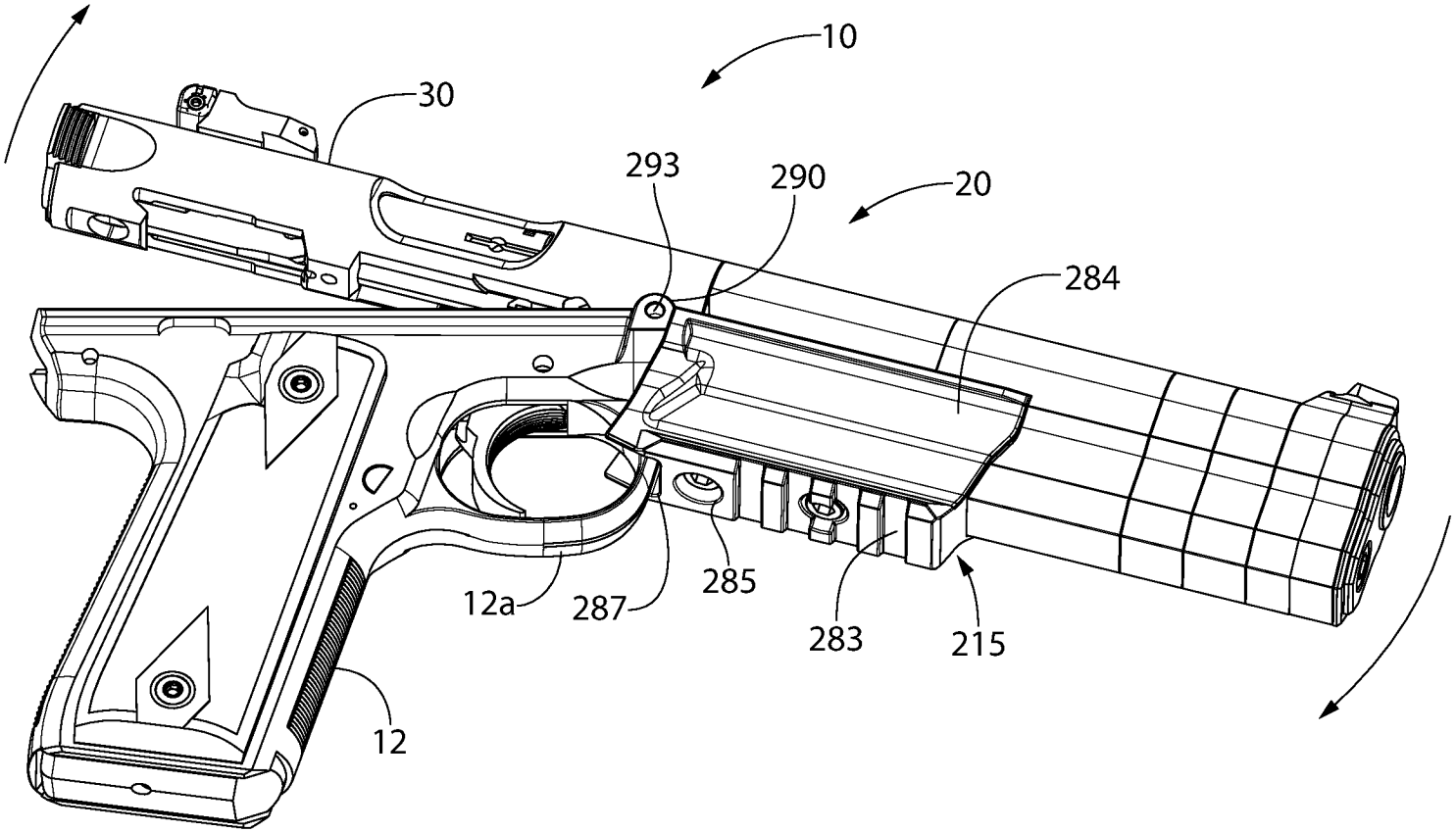
FIG. 20 is a perspective view of the pistol in an open tilted position.

In operation, initially, the latch 350 is in the rearward locked position and barrel-receiver assembly 20/30 is in the closed position. Next, latch 350 is pushed in a longitudinal axial direction to the forward unlocked position. This unlocks the barrel-receiver assembly from the frame 12 and allows the assembly to be pivotably tilted forward and downward, thereby raising the rear end of the receiver 30 upwards to the tilted open position as shown in FIG. 20. The hooked lug 400 of barrel-receiver assembly 20/30 is still engaged with pivot protuberance 452 of the frame pivot insert 450. To fully remove the barrel-receiver assembly 20/30 from pistol frame 12, the barrel-receiver assembly is then simply lifted in an upward motion off the frame to disengage the pivot protuberance 452 from the hooked mounting protrusion 408 of the receiver. During this motion, the pivot protuberance 452 slides forwards and downwards in slot 402 on the barrel-receiver assembly 20/30 from the closed top end outwards through the open bottom end 401 of the slot. The barrel-receiver assembly may now be raised upwards and completely lifted off of the frame (not shown). Notably, the barrel-receiver assembly 20/30 removal is completed without tools (e.g. pivot pin punch, hammer, etc.) while the pivot protuberance 452 remains attached to frame 12 during the entire process, thereby advantageously simplifying maintenance and inspection of the firing mechanism. Particularly when field stripping the pistol for maintenance, there are no removed mounting hardware parts to be lost that would prevent the pistol from being reassembled to the ready-to-fire condition.

Referring to FIGS. 8 and 9, pistol 10 further includes a trigger-actuated firing mechanism including a movable trigger 14 operable to cock and release a pivotable hammer 40 (not shown) that strikes the firing pin 54 of the bolt assembly 50. Commonly owned U.S. Pat. No. 9,791,223, which is incorporated herein by reference, discloses a firing mechanism for use with the present pistol 10. Other possible embodiments may instead comprise an axially reciprocating-cockable striker in lieu of a hammer, which is well known to those skilled in the art without further elaboration. The hammer assembly may further include a hammer strut 41 and spring 42 operable to bias the hammer 40 in a forward direction towards an axially movable firing pin 43. The hammer strut and spring are secured inside and guided in motion at least in part in frame 12 by a tubular main spring housing further described below. Trigger 14 is mechanically linked to hammer 40 and a rotatable sear 44 via trigger bar 45. The trigger bar is operable to cock hammer 40 into a rearward ready-to-fire position. Sear 44 operates to hold the hammer in the rearward cocked position. Pulling trigger 14 rotates the sear 44, which in turn releases the hammer 40 to strike the rear end of firing pin 43. The front end of the firing pin 54 strikes a chambered cartridge and discharges the pistol 10

In operation, pulling the trigger 14 releases the hammer 40 which strikes and drives the firing pin 54 forward to detonate the cartridge in the manner described above. This in turn drives the bolt 50 rearward (within the receiver 30 which remains axially fixed in position on grip frame 12) under the recoil forces to extract and eject the cartridge casing through an ejection port 18 in the side of the receiver 30. The bolt 50 is returned forward under the biasing force of a recoil spring 58. The foregoing type of bolt firing mechanism may be found, for example without limitation, in a Ruger Mark IV pistol available from Sturm, Ruger & Company, Inc. of Southport, Conn. However, it will be noted that embodiments of a barrel system and bolt mechanism according to the present disclosure are expressly not limited in use to this particular pistol and may be applied with equal benefit to other type pistols and rifles.

Referring to FIGS. 8-11, the front suppressor portion of barrel assembly 20 includes a plurality of horizontally (longitudinally) stacked and gas-tight press-fitted interlocked baffles including a rearmost blast baffle 240 and plurality of primary baffles 300, mounting adapter 210 mounted to barrel insert 60 of the barrel assembly 20 for affixing the baffles to the barrel insert, and a distal front end cap 43 removably attached to the foremost of baffles 300, namely the front foremost primary baffle 301 at the front end 23 of the barrel assembly. The blast baffle 240 and primary baffles 300, 301 are configured to form a gas-tight press-fitted frictional interlock to each other creating a self-supporting baffle assembly when separated from the firearm. The front suppressor portion may have a vertically elongated and oblong shape in one embodiment having a height greater than its width in transverse cross section. Each of the foregoing components of the suppressor portion will now be described in further detail.

The suppressor mounting adapter 210 is shown in further detail in FIGS. 12-19. Referring to these and FIGS. 8-11, mounting adapter 210 is configured and constructed to removably couple the baffle assembly to the receiver 30. Mounting adapter 210 in turn is removably secured to the receiver 30 and barrel insert 60. Mounting adapter 210 has a vertically elongated and oblong body defining an annular and vertically elongated oblong outer wall 280 that forms a perimeter of the adapter. The mounting adapter 210 includes a partially open front end 112, partially open rear end 113, upper section 110, and lower section 111. Outer wall 280 of the upper section 110 may be part-cylindrical in shape in part having an arcuate convexly curved top wall section 110*a* and adjoining opposed and parallel lower sidewall sections 110*b* which may be substantially slab-shaped (i.e. flat) in one embodiment. In one embodiment, outer wall 280 of the lower section 111 may be multi-faceted and polygonal in transverse cross section one embodiment including opposed parallel flat upper sidewall sections 111*a*, adjoining opposed flat lower angled sidewall sections 111*b*, and an adjoining flat bottom wall section 111*c*. Bottom wall section 111*c* is oriented perpendicular to sidewall sections 111*a*. Angled wall sections 111*b* are oriented obliquely to bottom wall section 111*c* and sidewall sections 111*b*. Upper section 110 has a greater lateral or transverse width than lower section 111 in one embodiment. Other configurations of the mounting adapter 210 may of course be used.

Upper section 110 of mounting adapter 210 defines a front opening 230 and opposing rear opening 231. An internal upper through passage 115 extends between the openings of the upper section 110 and is coaxially aligned with longitudinal axis LA. Through passage 115 may circular in transverse cross section in one embodiment. Through passage 115 is configured to receive the barrel insert 60 therein when the mounting adapter 210 is secured to the receiver 30. When the barrel insert 60 is completely coupled to the adapter 210 via muzzle cap 200 as seen in FIGS. 9 and 10, it bears noting that the upper through passage 115 is fluidly isolated from the forward blast baffle 240 or combustion gases from discharging the firearm. Barrel insert 60 supports the adapter 210, and in some embodiments as illustrated may provide complete support for the adapter independently of the receiver. The interior surface 217 of through passage 115 defines a pair of axially spaced apart front and rear annular protrusions 218, 219. Protrusions 218, 219 each project radially inwards into through passage 115 forming rims or ledges arranged to engage the barrel insert 60 as best shown in FIGS. 9 and 10. Annular protrusion 218 engages rear mounting portion 63 of barrel insert 60 and annular protrusion 219 engages forward retention portion 64 of the insert. The reduced diameter threaded front extension 69 of the barrel insert 60 projects through an axial opening defined by the front annular protrusion 219 to threadably engage muzzle cap 200. The rear annular protrusion 218 defines a rearward facing and recessed annular bearing surface 218*b* which engages annular flange 66 on barrel insert 60. An inward facing annular seating surface 218*a* is defined by rear annular protrusion 218 as well to engage barrel insert flange 66. When mounting adapter 210 is installed on the barrel insert 60, the annular flange 66 of the insert may be completely received in the rear of the mounting adapter.

The front annular protrusion 219 of mounting adapter 210 defines a forward facing annular seating surface 234 which engages a mating rear facing surface formed on the annular rear end 201-2 of the muzzle cap 200 when mounted to the barrel insert 60. The protrusions 218, 219 act as radial spacers which prevent the intermediate portion 65 of barrel insert 60 from contacting interior surface 217 of the upper through passage 115 in the adapter, thereby contributing to formation of the annular space 67 therebetween as previously described to minimize heat transfer between the barrel insert and mounting adapter 210. The annular protrusions 218, 219 further provide a mounting function, as further described herein.

The lower section 111 of mounting adapter 210 similarly defines a front opening 232, rear opening 233, and lower through passage 260 extending therebetween. Lower through passage 260 is physically and fluidly separated from upper through passage 115 by a horizontal partition wall 238. Lower through passage 260 comprises in communication (without threaded insert 261 or mounting rod 262 in place as explained below) a rear chamber 235, intermediate chamber 236, and front chamber 239. Front chamber 239 is in fluid communication with the lower rear chamber 249 of blast baffle 240. Intermediate chamber 236 defines a threaded socket which engages the threaded rear end 263 of baffle mounting rod 262. In one embodiment, the threaded socket may be provided by an internally threaded insert 261 mounted in intermediate chamber 236. When in place, threaded insert 261 fluidly isolates the front chamber 239 from the rear chamber 235 with mounting rod 261 engaged with the insert to prevent fouling of the rear chamber from combustion gas. Insert 261 defines threaded through bore 264 having open front and rear ends which allows the threaded rear end of the mounting rod 262 to project rearwardly beyond the threaded insert 261 into the rear chamber 235 to varying degrees for length adjustment of the rod. The mounting rod is selectively adjustable in length by rotating the mounting rod between a first long configuration in which the rear end of the mounting rod does not extend rearward past the through socket of insert 261, and a second short configuration in which the rear end of the mounting rod projects rearward beyond the through socket into the rear chamber 235 of the lower through passage 235 of the mounting adapter 210. The short configuration is used for short configuration of the suppressor assembly shown in FIG. 20. The long configuration is used for the long configuration of the suppressor assembly shown in FIGS. 1-5. Advantageously, this allows a single mounting rod 262 to be used for both short and long suppressor configurations as further described herein. Front chamber 239 is forwardly open to receive rod 262 therethrough and provide access to the threaded insert 261. Rear chamber 235 is rearwardly open to allow the insert to be mounted in intermediate chamber 236 in one embodiment by any suitable means. Intermediate chamber 236 may be circular in transverse cross section and rear chamber 235 may have a generally rectilinear cross-sectional shape in one embodiment. Rear chamber 235 may be larger in height and width than the diameter of intermediate chamber 236. In operation, threaded rear end 263 of baffle mounting rod 262 screws into insert 261 to rotatably and removably couple the rod to the adapter 210 for mounting the baffles 240 and 300 to the pistol, as further described herein.

In one non-limiting embodiment, the mounting adapter 210 is configured to be supported by the barrel insert 60 and locked into position on the receiver 30 independently of the receiver 30 or grip frame 12 (see, e.g. FIGS. 9 and 10). Although adapter 210 may abuttingly engage the front end 31 of receiver 30, there is no locking or supportive engagement therebetween. To achieve this, the upper section 110 of adapter 210 may extend rearwards from rear end 113 by a greater distance than the rear end of the lower section 111 (best shown in FIGS. 16 and 17. This axially spaces the lower section 111 forward and apart from the trigger guard 12*a* of the grip frame. In addition, this axial spacing allows the barrel assembly 20 to rotate downwards when the barrel-receiver assembly 20/30 is in the open maintenance removal position without interference (see, e.g. FIG. 20).

With additional reference to FIGS. 10A-C, the distal front end cap 270 comprises a vertically elongated and oblong end wall 273 defining a front side 271 and opposite rear side 272. End wall 273 defines a forwardly open recessed receptacle 274 at bottom. Receptacle 274 includes lower aperture 266 for extending baffle mounting rod 262 therethrough. An enlarged head 265 of the mounting rod is received in the receptacle, thereby flushly mounting the head with the front side 271 of the end cap 270. The head 265 may have a hex shaped or other shaped tool socket which opens forward for receiving a complementary configured end of a tool therein (e.g. hex key, screwdriver, etc.) for rotating the mounting rod when securing the suppressor mounting adapter 210. In one embodiment, receptacle 274 may be formed in a tubular extension extending rearwards from end wall 273 of the end cap.

An upper exit aperture 267 in front end cap 270 is in fluid communication with the internal passageway P of the suppressor. Aperture 267 is sized to allow a fired projectile such as a bullet or slug to pass therethrough. Exit aperture 267 is coaxially and concentrically aligned with the longitudinal axis LA and longitudinal bore 62 of barrel insert 60. In one non-limiting embodiment, the exit aperture 267 continues and opens rearward into a tubular extension 268 disposed in passageway P inside the end cap. The tubular extension may be integrally formed with end wall 273 in one embodiment and extends rearwardly from the wall towards the breech end of barrel assembly 20.

In one embodiment, front end cap 43 further includes a rear facing raised lip 269 protruding rearwards from a rear side 272 of the end cap. The lip 269 is configured and dimensioned for engageable insertion into the foremost front primary baffle 301 (see, e.g. FIGS. 23-25). The raised lip extends around the entire perimeter of the end cap 43 and is spaced slightly inwards from the peripheral edges of the cap (best shown in FIG. 9) to create a peripheral shoulder from receiving the distal front end of the front primary baffle 301. The shoulder abuttingly engages the front edge 79 of baffle 301, thereby helping secure the baffles in place on the pistol by applying a compressive force to the stack of baffles 240, 300 and 301 when the baffle mounting rod 262 is tightened.

Mounting rod 262 (best shown in FIGS. 8-11) is axially elongated having a smooth shaft which extends from the front end cap 270 through the stack of baffles 240, 300, and 301, and into the rear mounting adapter 210. In one embodiment, mounting rod 44 may be in the form of a cap screw with threaded rear end 263 at one end of the shaft and the front diametrically enlarged head 265 having a forward facing tool recess for rotating the rod. Mounting rod 44 preferably has an axial length (measured parallel to the longitudinal axis LA) which is longer than the assembled length of the stacked baffles 240, 300, and 301, for reasons which will become evident. It bears noting that the rear lower gas expansion chamber 235 has a sufficient axial length (measured along the longitudinal axis LA) to allow the threaded rear end 263 of rod 262 to be projected into and received in the chamber for creating a shorter configuration of the integrally suppressed barrel assembly 20, as further described herein. This allows the user (or firearm manufacturer) to change the number of baffles from a shorter stack to a longer stack (or vice-versa), thereby creating a user customizable sound suppression performance using the same convenient baffle mounting system disclosed herein.

The blast baffle 240 and primary baffles 300 including the foremost baffle designated by reference numeral 301 will be described next. It bears noting that the front baffle 301 has a slightly different configuration than baffles 300 rearward of it, as explained below.

Figure 30:
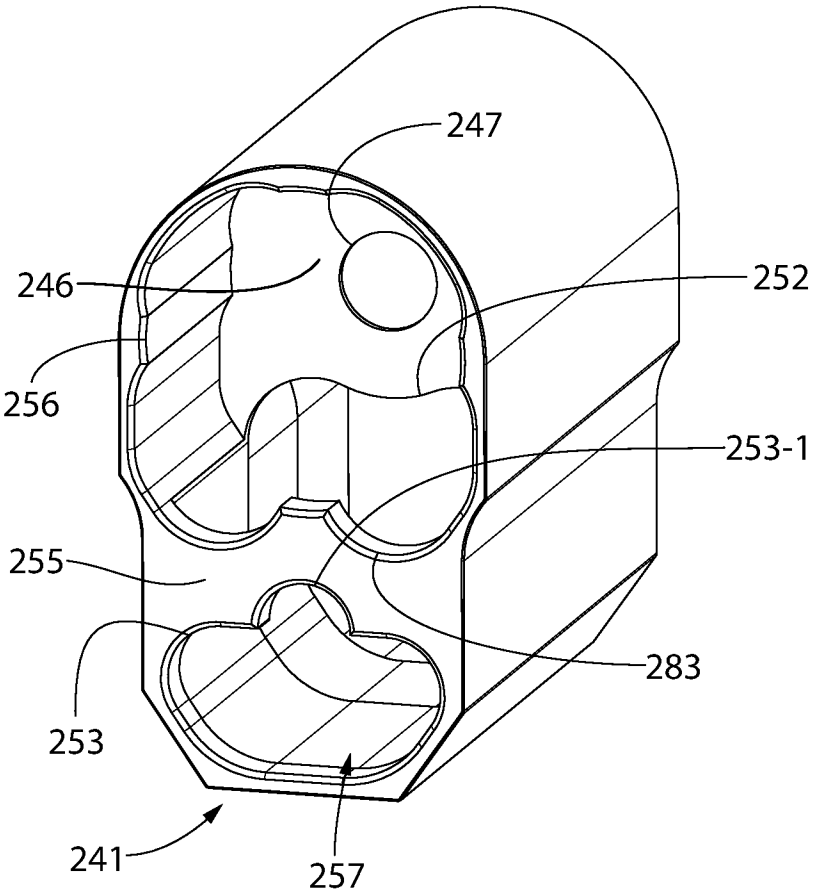
FIG. 30 is a front perspective view thereof.
Figure 29:
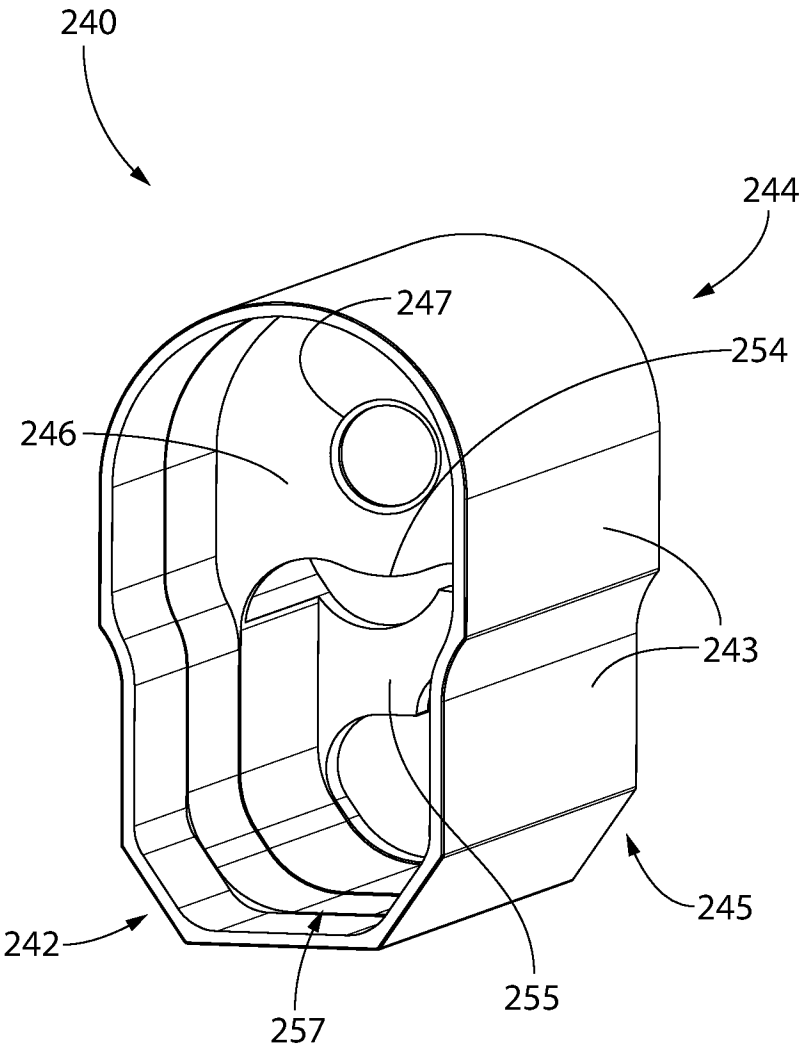
FIG. 29 is a rear perspective view of a blast baffle of the suppressor assembly.
Figure 31:
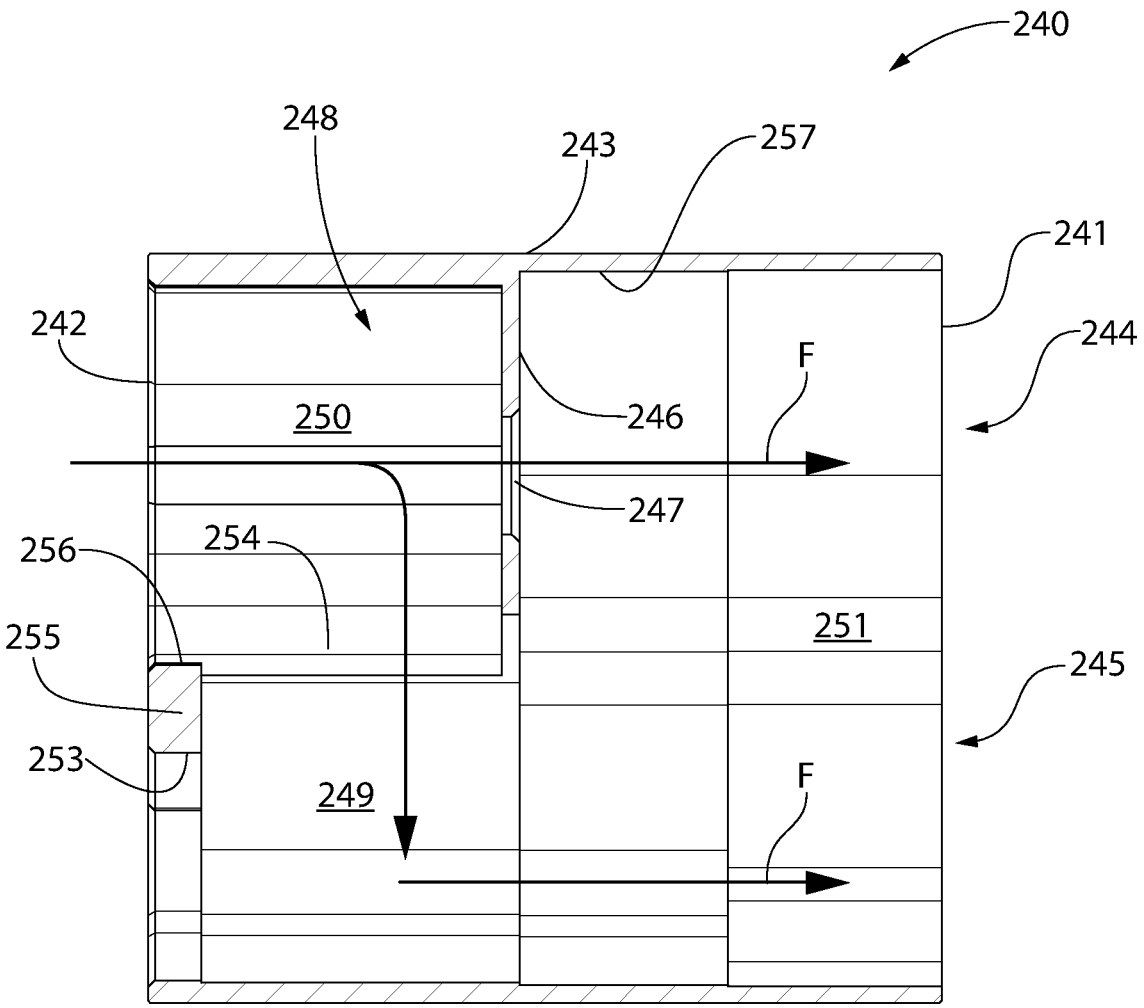
FIG. 31 is a side cross-sectional view thereof.
Figure 32:
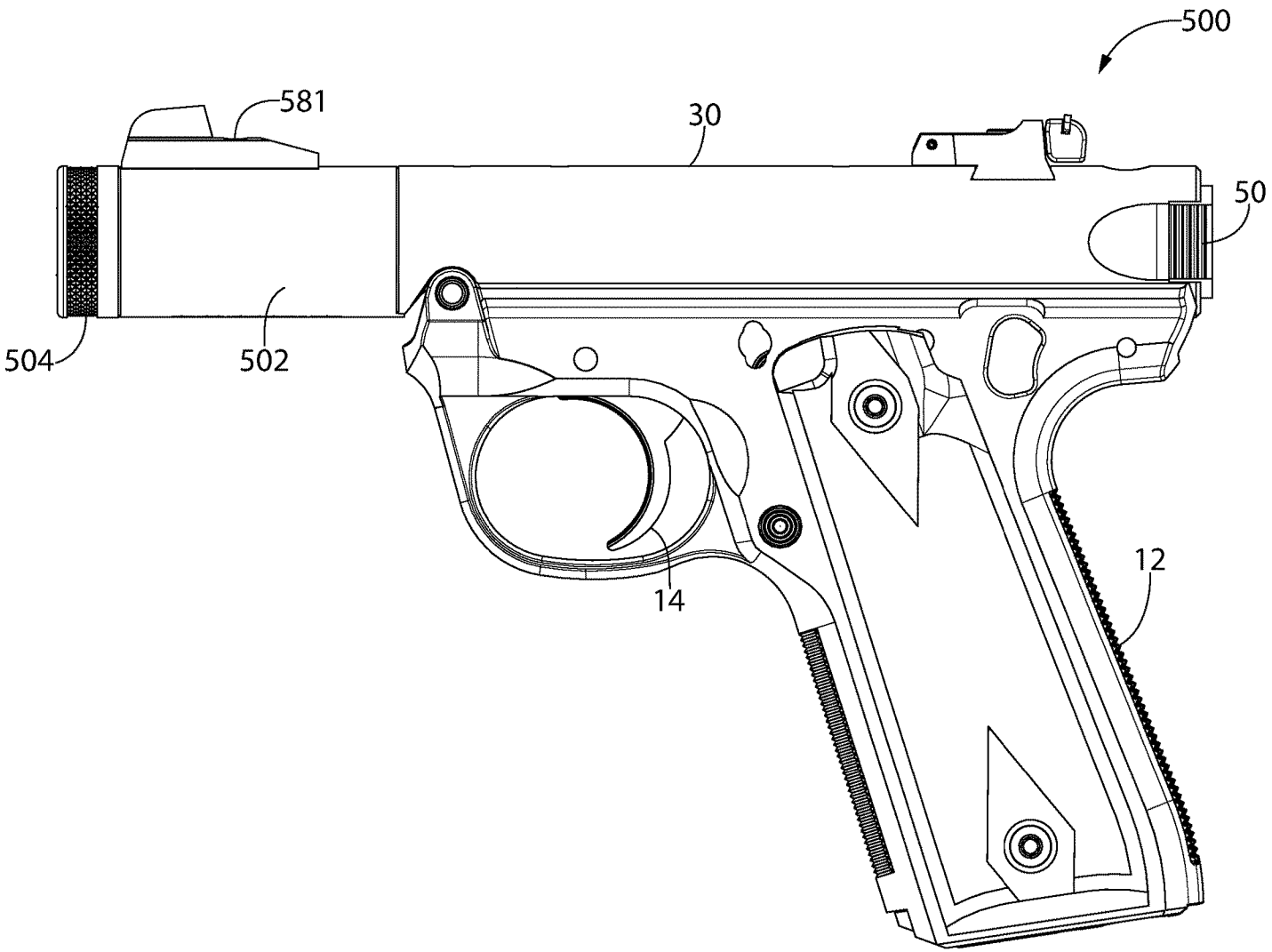
FIG. 32 is a left side view of a convertible unsuppressed pistol configured for conversion to an integrally suppressed pistol as shown in FIG. 1 or 21A using a conversion kit.
Figure 33:
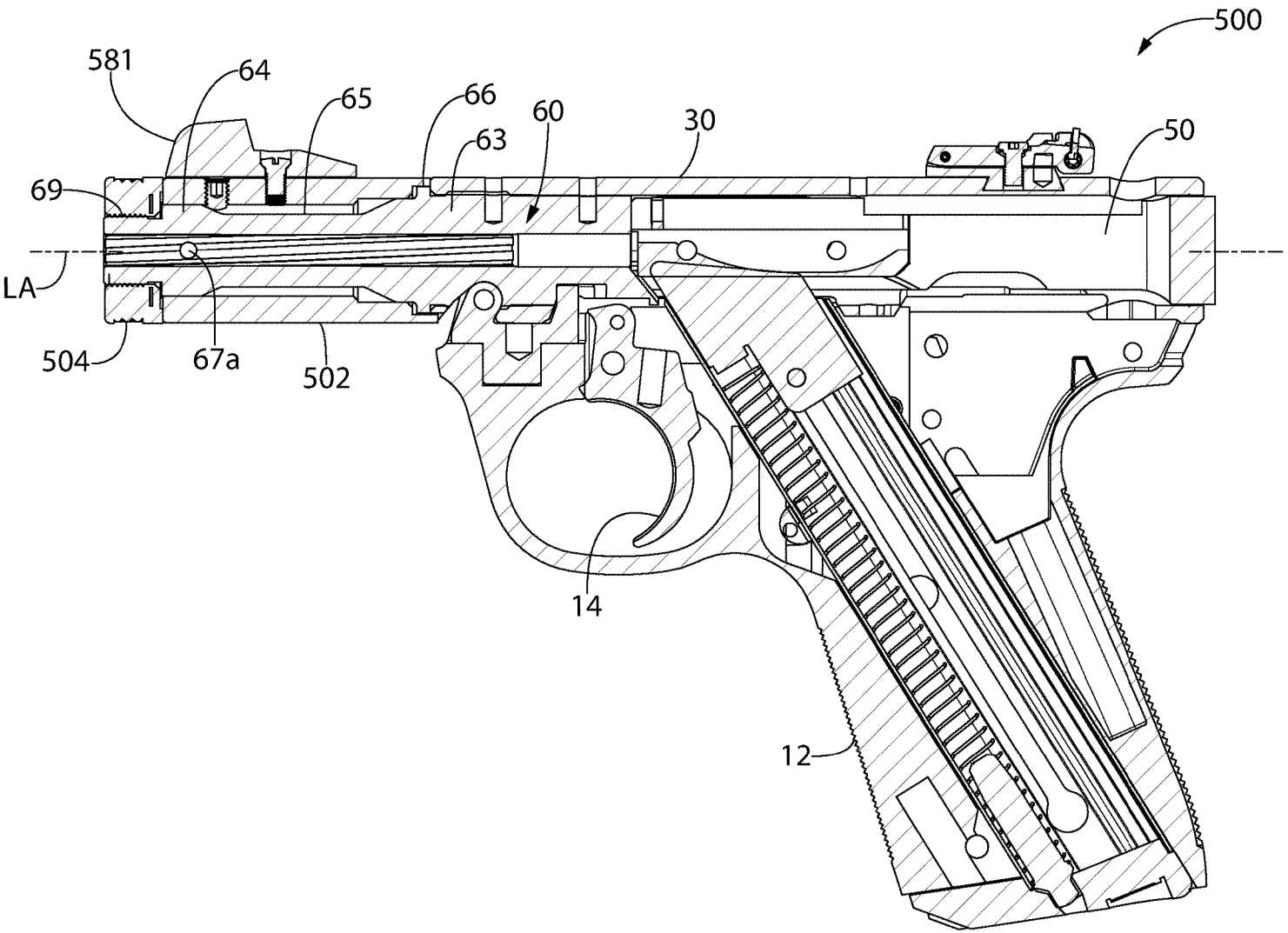
FIG. 33 is a cross-sectional view thereof.
Figure 34:
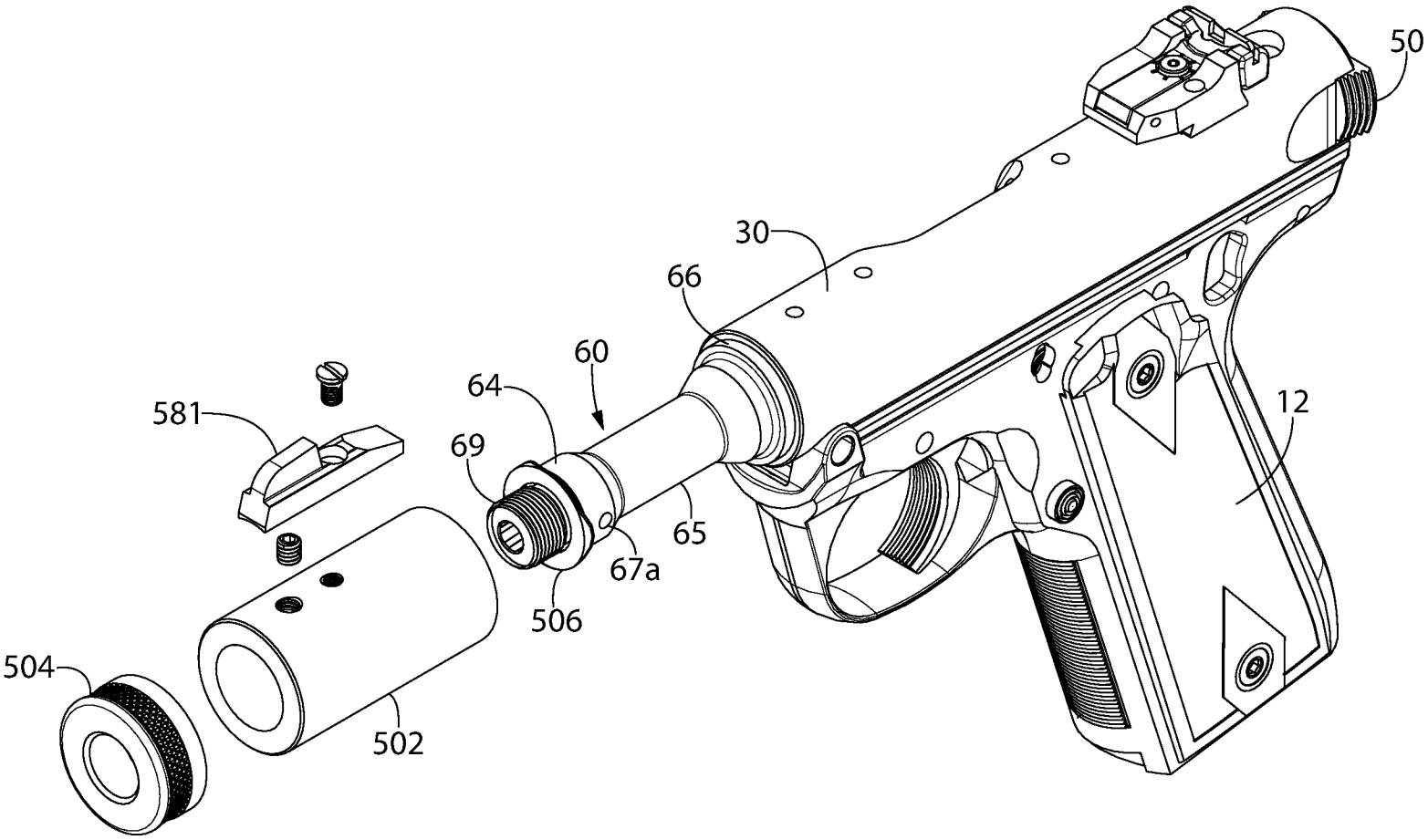
FIG. 34 is an exploded perspective view thereof.
Figure 35:
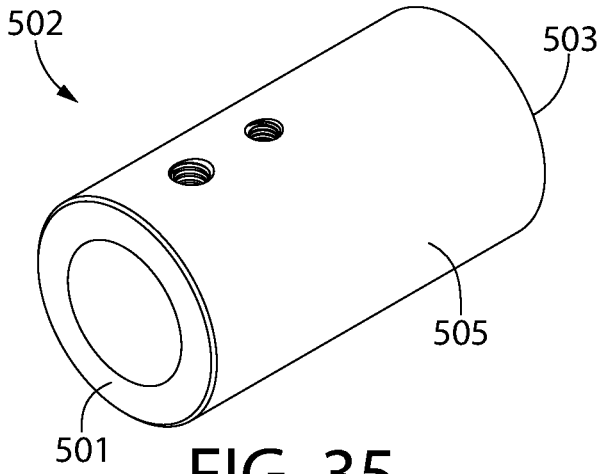
FIG. 35 is a front perspective view of a barrel shroud of the pistol of FIG. 32.
Figure 36:
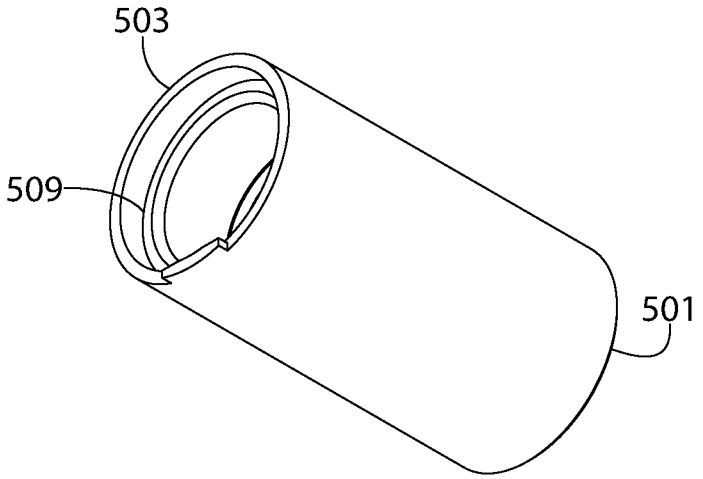
FIG. 36 is a rear perspective view thereof.
Figure 37:
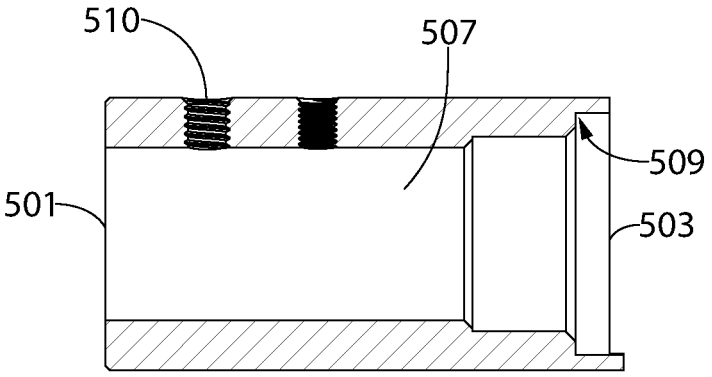
FIG. 37 is a side cross-sectional view thereof.

FIGS. 29-31 show blast baffle 240 in further detail. Referring to these and FIGS. 8-11, blast baffle 240 has a vertically elongated and oblong body defining a perimetrically annular and corresponding vertically elongated and oblong outer wall 243 of non-circular cross section. In the non-limiting illustrated embodiment, it bears noting that the outer walls of the mounting adapter 210, blast baffle 240, and primary baffles 300 (including the front primary baffle 301) may each have substantially the same complementary configuration in cross-sectional shape, profile, and dimensions as shown. This includes an upper section including an arcuately convex configuration on top and a lower multi-faceted section of polygonal configuration in transverse cross section. Because the outer walls of these components collectively define the exposed outer surfaces of the front portion of the pistol barrel assembly 20, this provides an aesthetically pleasing and uniform appearance with smooth and flush transitions between these removably assembled and stacked barrel assembly components. Accordingly, it bears noting that the foregoing description of the shapes of the outer wall 280 and parts thereof in the upper and lower sections 110, 111 of the mounting adapter 210 also applies to the shapes of the outer walls of the blast baffle 240 and primary baffles 300 (including front primary baffle 301) without need for full repetition in the descriptions of the baffles that follow.

Blast baffle 240 further includes a partially open front end 241, partially open rear end 242, upper section 244, and lower section 245 formed by outer wall 243. Upper section 244 may include an arcuately and convexly curved top wall portion on top transitioning on each lateral side into opposing vertical flat wall portions of the upper section. Lower section 245 may be polygonal shaped formed by opposing vertical flat wall portions, opposing angled wall portions obliquely angled to the flat portions, and a horizontal bottom wall portion. Upper section 244 has a greater lateral or transverse width than lower section 245. The front and rear ends 241, 242 of the blast baffle outer wall 243 are configured to abuttingly engage the outer wall 280 of mounting adapter 210 and the rearmost primary baffle 300 creating mutually flush outer surfaces when mounted thereto for a uniform streamlined appearance, as noted above.

A vertical partition wall 246 spaced between the ends 241 and 242 extends downwards from the top wall portion of outer wall 243 for about one-half the height of blast baffle 240. Wall 246 separates the interior 257 of the blast baffle 240 into a plurality of front and rear gas expansion chambers, including an upper rear gas expansion chamber 250 (i.e. blast chamber), a lower rear gas expansion chamber 249 rearward of the wall, and a common front gas expansion chamber 251 forward of the wall. The upper and lower rear gas expansion chambers each may be defined as occupying approximately one-half of the height of the blast baffle 240 and are in open fluid communication with each other. Common front gas expansion chamber 251 may extend for the full height of the interior of blast baffle 240. The rear gas expansion chambers 249, 250 each extend for a portion of the height of the baffle, such as approximately one-half the height in one implementation. Rear expansion chambers 249, 250 collectively extend for the full height of the baffle and are not physically separated from each other defining a common full height space. Rear upper gas expansion chamber 250 has a generally tubular configuration and related round cross section corresponding to the shape of upper section 244 of the baffle body. Lower rear gas expansion chamber 249 has a generally polygonal configuration and related polygonal cross section corresponding to the shape of the lower section 245 of the baffle body. The common front gas expansion chamber 251 has a combination of these two configurations.

The partition wall 246 is axially spaced apart from the muzzle cap 200 by a predetermined axial distance D1 carefully selected to balance competing interests of maximizing muzzle blast sound suppression and optimizing combustion gas distribution within the blast baffle 240. The upper rear gas expansion chamber 250 or "blast chamber" acts to reduce 1st-round "pop" noise (secondary ignition of oxygen within the suppressor, which results in a louder than normal report from the firearm when first fired), as noted above. Accordingly, the axial separation distance between the partition wall 246 and muzzle cap 200 might be optimized based on criteria to maximize first round pop reduction. However, this may result in a placement of partition wall 246 that is not ideal to effectively distribute and force gas downwards into the lower rear gas expansion chamber 249 of the blast baffle 240 to improve overall muzzle blast noise suppression. Accordingly, the placement of partition wall 246 is tuned by adjusting and selecting axial distance D1 to balance reduction of 1st round "pop" noise to a maximum while optimizing gas flow distribution within the blast baffle 240 upon the projectile exiting muzzle cap 200. Placement of partition wall 246 is therefore not arbitrary. The combustion gas flow distribution within blast baffle 240 is shown by directional flow arrows F in FIGS. 9 and 10. In one embodiment, partition wall 246 may be located approximately midway between front and rear ends 241, 242 of blast baffle 240, or slightly rearward thereof.

Common front gas expansion chamber 251 is in fluid communication with both rear gas expansion chambers 249, 250 creating maximum volume for partial expansion of the combustion gases to suppress the muzzle blast or noise. A vertical circular aperture 247 in partition wall 246 coaxially aligned with longitudinal axis LA and projectile passageway P fluidly connects upper rear gas expansion chamber 250 with front gas expansion chamber 251. A relatively large axial flow aperture 252 is formed beneath the partition wall 246 to allow gas to flow forward from the lower rear gas expansion chamber 249 into the lower half of the common front gas expansion chamber 251. Flow aperture 252 may extend for a majority of the height of the blast baffle 240.

Blast baffle 240 includes a vertical rear wall 255 defining a non-polygonal larger upper aperture 256 and a non-polygonal smaller lower aperture 253. Both apertures 256 and 253 allow gas to flow forward from the blast baffle into the primary baffles 300. Lower aperture 253 allows mounting rod 262 to pass through the blast baffle 240 to the mounting adapter 210 for threaded securement. Lower aperture 253 may optionally include a semi-circular and centered rod locating edge 253-1 complementary configured to the diameter of the mounting rod 262 which may pass immediately below and optionally engage the semi-circular edge portion. This facilitates locating and aligning the rear end of the mounting rod 262 with the threaded through bore 264 of threaded insert 261 mounted in the mounting adapter 210 when assembling the baffle assembly to the firearm.

The lower rear gas expansion chamber 249 of blast baffle 240 creates additional internal volume for combustion gas expansion below the upper rear gas expansion chamber 250. When pistol 10 is fired, the combustion gas circulates between the gas expansion chambers 249-251. High velocity gas emitted from the muzzle will expand in a roughly conical shape as it travels forward. As this gas encounters wall 246, a portion of it is forced to expand to the next lowest pressure area, which is the lower volume created by lower rear gas expansion chamber 249. As this occurs, gasses that are able to pass through upper aperture 247 expand conically and encounter the first primary baffle, thereby partially trapping a portion of the gas. The gas that has expanded into the lower volume of lower gas expansion chamber 249 then travels forward through lower aperture 253 and mixes with the gas trapped by the primary baffle immediately forward of the blast baffle 240 in the gas expansion chamber of the rearmost primary baffle 300. It bears noting that front chamber 239 of mounting adapter 210 is contiguous with and in fluid communication with the lower rear gas expansion chamber 249 of the blast baffle, thereby advantageously creating additional gas retention volume and delay.

The primary baffles 300 will now be described in greater detail. In one non-limiting embodiment illustrated herein, baffles 300 are stackable, press-fit frictionally interlocking, and may be configured with similar features to the pushed or skewed cone baffles disclosed in commonly-owned U.S. Pat. No. 9,835,400, which is incorporated herein by reference. In the present invention and adaptation for hand-held firearms, however, an outer sleeve is not required to support the stack of baffles via the new self-supporting removable baffle and mounting adapter assemblies disclosed herein which forms the outermost pressure boundary of the barrel assembly. Accordingly, the shape of the outer wall of the present primary baffles 300 is different than the primary baffles disclosed in the foregoing Patent. The present baffles further do not include a distinct upper and lower tubular gas expansion chamber but rather a single open chamber, as further described herein.

Figure 24:
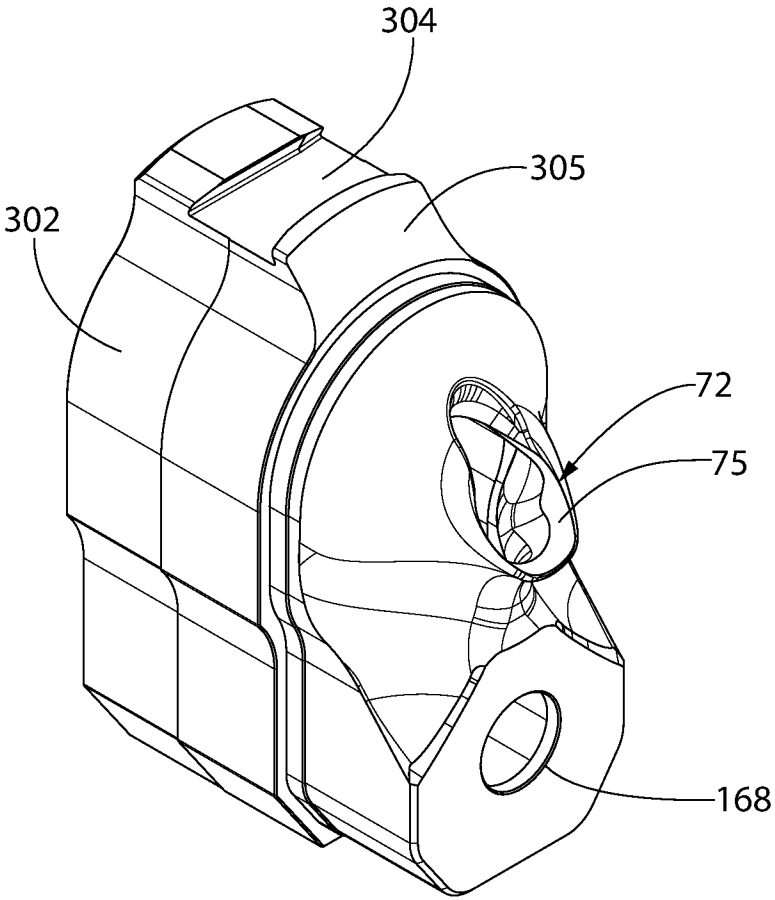
FIG. 24 is a rear perspective view thereof.
Figure 23:
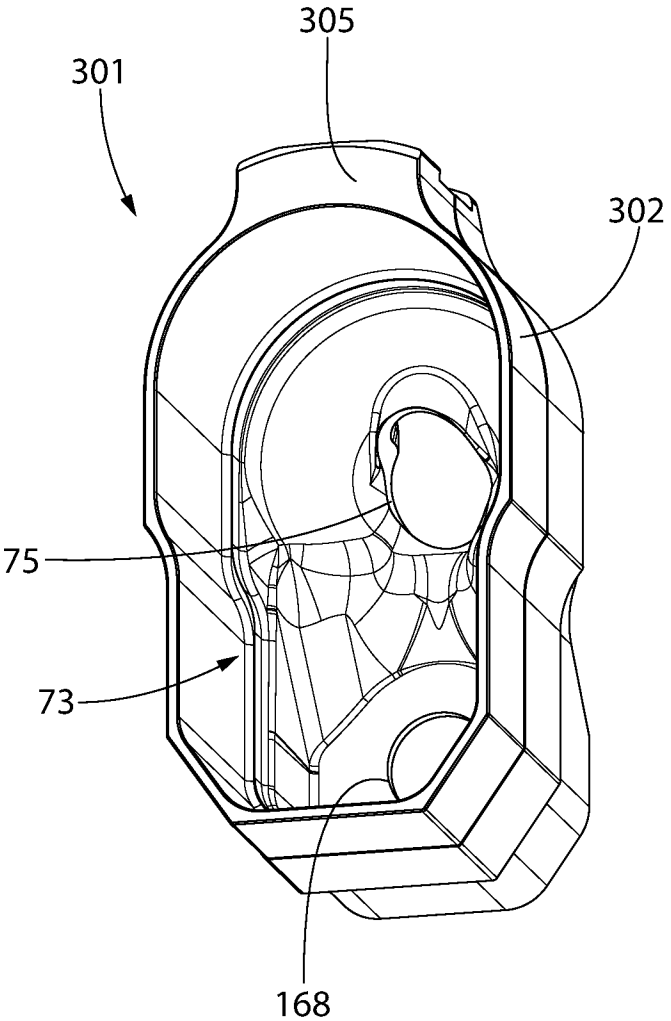
FIG. 23 is a front perspective view of a foremost or front primary baffle of the suppressor assembly.
Figure 25:
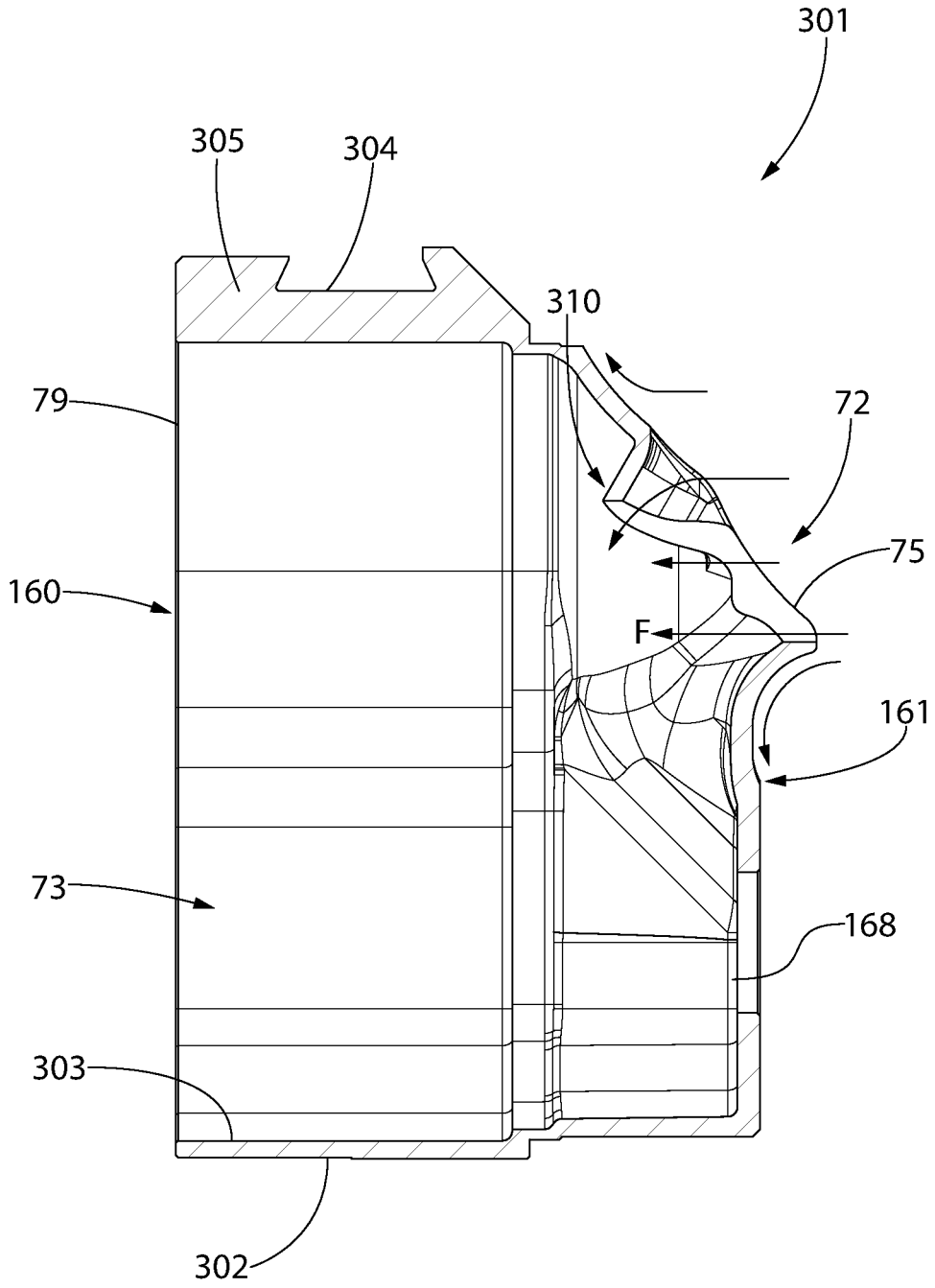
FIG. 25 is a side cross-sectional view thereof.

FIGS. 23-28 show the primary baffles 300 in greater detail (FIGS. 23-25 showing the foremost primary baffle configured for mounting a front sight directly thereto as explained elsewhere). Referring now to these figures and additionally FIGS. 8-11, the primary baffles 300 including foremost primary baffle 301 may each be configured similarly and generally comprise a vertically elongated and oblong body defining an open front end 160, partially closed rear end 161, and annular vertically elongated and oblong outer wall 302 extending between the ends. The body defines an arcuate convexly curved upper section 71 on top and polygonal shaped lower section 163 each formed by outer wall 302. Upper section 71 has a greater lateral or transverse width than lower section 163. The transverse inset distance between the narrower lower section 163 and laterally wider upper section 71 ensures that the lower section 163 does not unduly extend laterally outward too far when accessory rail 215 is mounted thereto to maintain a compact profile and appearance of the pistol (see, e.g. FIG. 7).

Outer wall 302 of primary baffle 300 circumscribes an interior 303 defining an internal gas expansion chamber 73 that extends a full height of baffle 300 from top to bottom. Gas expansion chamber 73 extends from the front end 160 to rear end 161. A lower portion of gas expansion chamber 73 advantageously creates additional internal volume for combustion gas expansion below the longitudinal axis LA of the pistol and the projectile pathway P. The outer walls 302 of each primary baffle 300 (including front baffle 301) have a complementary cross sectional shape and dimensions to the outer wall cross sectional shapes of the blast baffle 240 and mounting adapter 210 that collectively form the visible front barrel portion of the pistol 10.

Primary baffles 300 each include a rear extension 169 that defines rear wall 167 of the baffle body. In one embodiment, the rear wall 167 may be configured to define an asymmetrically shaped and curved upper hollow cone 72 protruding rearwardly from outer wall 302 of the baffle and a lower mounting portion 170 protruding rearwardly from the baffle. Cone 72 is formed by a complexly-curved concave wall segment 78 of the upper portion of the rear wall 167. The interior open upper gas expansion chamber 73 extends from the outer wall 302 rearwards inside both the cone 72 and lower mounting portion 170. In one embodiment, the cone 72 is formed integrally with the baffle body and tubular upper section 71 of the baffle 70 as a unitary structural part thereof. In other embodiments, the cone may be a separate component attached to sleeve via any suitable means such as welding, brazing, soldering, adhesives, fasteners, etc. in part depending on the material selected for the baffle.

The lower mounting portion 170 of rear wall 167 defines a mounting aperture 168. The lower mounting aperture 168 fluidly communicates with the lower portion of gas expansion chamber 73. Rear wall 167 may be vertically flat in one embodiment which contrasts with the arcuately concave shape of the rear wall concave wall segment 78 surrounding the flat face and central aperture 75. Aperture 168 may be smaller in cross-sectional area than the central aperture 75 of baffle cone 72. Aperture 168 may have a smooth bore in one embodiment for allowing the baffle mounting rod 262 to slide therethrough, as further described herein. Aperture 168 may be round and sized slightly larger in diameter than the diameter of the mounting rod.

Gas expansion chamber 73 is configured and sized for insertion of the rear extension 169 (including upper cone 72 and lower mounting portion 170 of the next adjacent forward primary baffle 300 at least partially therein through open front end 160 of the baffle, as best shown in FIGS. 9 and 10. The outer wall 302 of baffle 300 has a distal front edge 79 which defines the front end 160 of the baffle and an opposite proximal rear edge 80 which adjoins and from which the cone 72 extends axially towards the rear end 161 of the baffle. The distal edge 80 has a stepped configuration in one embodiment forming a vertically oblong annular shoulder 80*a* at the transition between the outer wall 302 and rear extension 169 of the baffle. The annular shoulder 80*a* extends around the entire perimeter of baffle 300. Shoulder 80*a* defines a rear facing abutment surface for engaging the proximal edge 79 of the next adjacent rearward primary baffle 300 when the baffle stack is assembled, or in the case of the rearmost baffle 300 its abutment surface engages the front end 241 of the blast baffle 240. The stepped configuration between the rear extension 169 (which defines cone 72 and lower mounting portion 170) and oblong outer wall 302 slightly recesses the rear extension inwards around its perimeter which defines an outward facing oblong annular seating surface 77 that forms a frictional press fit into the distal edge 79 of the next rearward adjacent baffle. This creates a gas tight seal and self-supporting assembled baffle array which does not require an outer sleeve 41 for support. The outer walls 302 of baffles 300 therefore creates a primary pressure retention boundary or barrier for retaining the combustion gas pressure which does not rely on the secondary pressure retention boundary or barrier formed by an outer sleeve found in many suppressor designs. The rearmost primary baffle 70 forms a frictional press fit also with the front end 241 of the blast baffle 240 in a similar manner. The rear end 242 of the blast baffle 240 does not contain a shoulder, and instead directly abuts the front end 112 of the mounting adapter 210. It bears noting that press fitting between the primary baffles 300 (including front baffle 301) and blast baffle 240 collectively create a sealed internal volume to advantageously prevent or minimize gas out-leakage and carbon/lead from building up on the inside of an outer sleeve, thereby advantageously reducing maintenance and cleaning.

Cone 72 includes an internally open base end 81 connected to outer wall 302 and a free terminal end 82 defining a rear prominence. Cone 72 has a complex asymmetrical and skewed compound shape in one embodiment defined by the arcuately curved concave wall segment 78 formed on the upper portion of rear extension 169. The concave wall segment 78 of cone 72 extends obliquely to longitudinal axis LA from outer wall 302 of the baffle (see, e.g. FIG. 28). The concave wall segment 78 of cone 72 defines an axially elongated and oblong upper central aperture 75 which receives a projectile therethrough from the barrel insert bore 62. Central aperture 75 is coaxially and concentrically aligned with the projectile passageway P and bore 62. Central aperture 75 has a smaller open area than the inside diameter of the open base end 81 of the cone 72. The major axis of central aperture 75 (extending from front to rear) is longer than its minor axis (extending from side to side) similar to an ellipse. Preferably, the open area of central aperture 75 presents a rearward projected vertical diameter that matches or is slightly larger than the diameter of the barrel bore 34 to receive a projectile therethrough.

Figure 27:
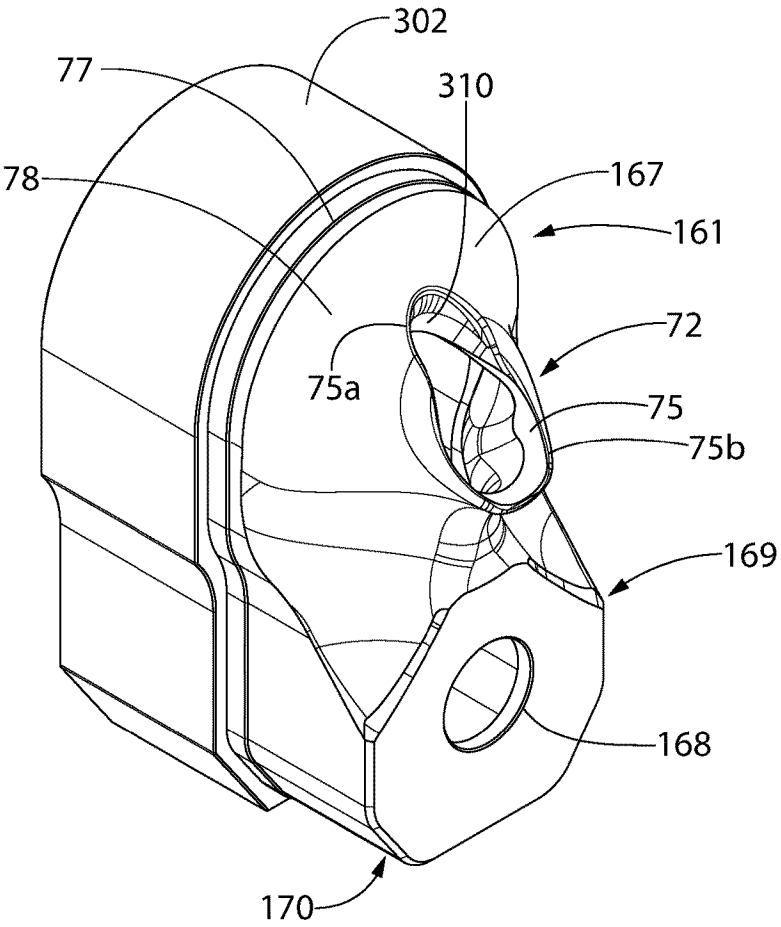
FIG. 27 is a rear perspective view thereof.
Figure 28:
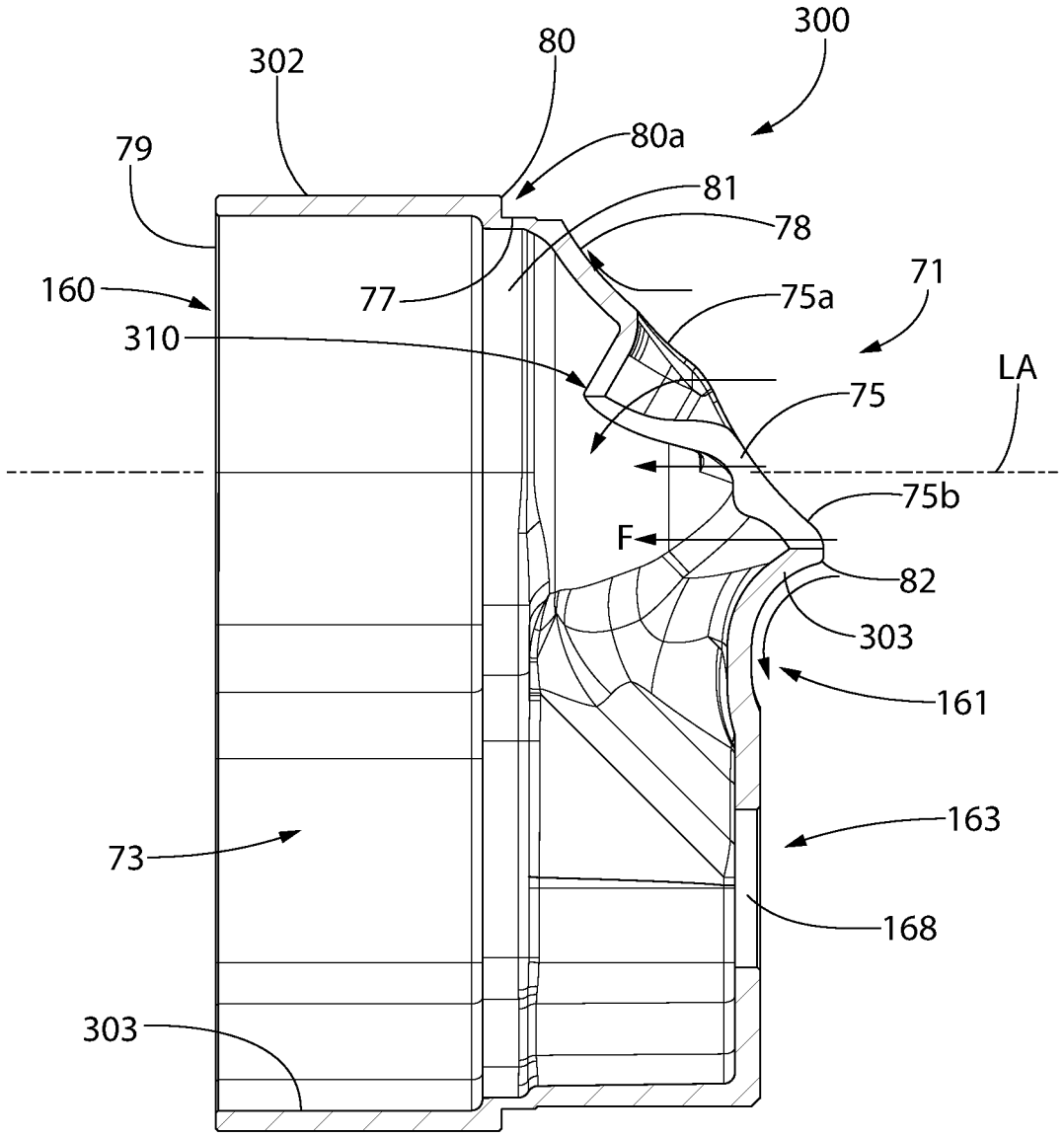
FIG. 28 is a side cross-sectional view thereof.

The central aperture 75 of primary baffle 70 is obliquely arranged and oriented to the longitudinal axis LA of the pistol 10 (see, e.g. FIG. 9). Accordingly, an acute and oblique angle is formed between longitudinal axis LA and the oblique plane in which the central aperture 75 substantially lies. Aperture 75 is angled to face generally both rearwards and upwards, thereby defining a rearward extension ledge 303 of concave wall segment 78 below aperture 75 that projects farther rearward than the portion of the wall segment above the aperture, as best shown in FIGS. 27 and 28. This rearward extension ledge 303 defines the rear prominence 82. In operation, the ledge below aperture 75 and concave configuration of the cone 72 encourages a substantial portion of the combustion gasses to spill over the concave wall segment 78 of the cone 72 and flow upwards in the upper portion gas expansion chamber 73 surrounding cone 72, reverse direction, and flow downwards into the lower portion of gas expansion chamber 73 below the projectile passageway P. This path of least resistance creates a strong cross-jetting that slows the progression of the gasses traveling in-line with the central aperture 75 to fill the lower portion of the gas expansion chamber 73 that surrounds the cone 72. This increases the sound deadening performance of the integrally suppressed barrel.

Central aperture 75 of cone 72 includes an upper minor portion 75*a* and a larger lower minor portion 75*b* in fluid communication with the minor portion. In some embodiments, upper lower minor portion 75*a* of the central aperture 75 may have a smaller lateral width which is less than the diameter of the bore 62 of barrel insert 60 because the projectile does not pass through this portion of the aperture. Conversely, the larger lower major portion 75*b* of the central aperture 75 having a lateral width larger than the minor portion 75*a*. Major portion 75*b* has a lateral width the same as or larger than the barrel insert bore 62 to allow passage of a projectile therethrough. The purpose of the upper minor portion 75*a* is to add extra open space above the projectile as it is passing through the central aperture 75 to permit combustion gas cross-jetting to initiate simultaneously which enhances sound suppression performance.

The cone 72 of each primary baffle 70 may be considered to be essentially shaped like an asymmetrical forced or skewed cone. The upper half section of the baffle cone segment 78 of rear wall 167 is designed to ramp the combustion gas pressure away from and around the central aperture 75 to gather at the lowest point on the upper half section of the cone segment against the baffle face. As the combustion gas pressure builds enough to "spill" over the oblong rim of the cone segment that defines the aperture 75 and flows into the aperture through the upper minor portion 75*a*, this causes gas cross-jetting into the next forward baffle upper gas expansion chamber 73.

Cross-jetting is extremely effective at disrupting the high speed combustion gasses traveling along the bore-line (i.e. longitudinal axis LA coaxial with central aperture 75), which if left alone would escape out of the suppressor at high pressures, thus creating a loud report. The gasses need to be slowed down to give them time to expand and cool. The cross-jetting of the rearmost primary baffle 300 causes the gasses to divert from the bore-line, get caught in the next downstream baffle gas expansion chamber 73 (of the next forward baffle), and then add to the cross-jetting flow of that baffle. Thus, the efficacy of each baffle 300 progressively improves closer to the distal front end of the barrel assembly 20. The asymmetrically skewed shape of the primary baffle 300 encourages this cross-jetting to occur faster than normal cone shapes. It is advantageous for this cross-jetting effect to occur quickly in order to slow as much escaping gas as possible for improving sound suppression.

Figure 26:
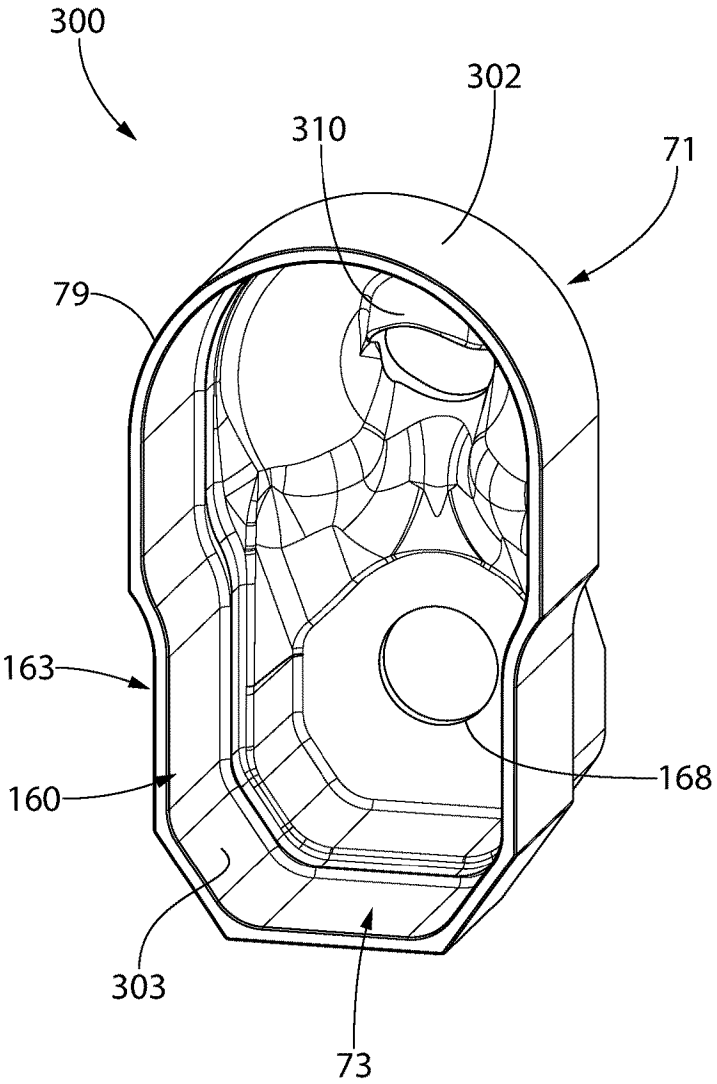
FIG. 26 is a front perspective view of a basic primary baffle of the suppressor assembly.

In one embodiment, each primary baffle 300 (including front primary baffle 301) includes a semi-circular gas deflection shroud 310 as best shown in FIGS. 26-28. Shroud 310 comprises an arcuately curved wall which projects forward and downward into gas expansion chamber 73 from concave wall segment 78 of the upper portion of the rear wall 167. The shroud 310 forms an overhang or hood around the upper minor portion 75*a* of central aperture 75 defined by cone 72 of the baffle. When pistol 10 is fired, a portion of the combustion gas flowing through aperture 75 which impinge shroud 310 and be directed downwards inside gas expansion chamber 73 (see direction gas flow arrows F in FIG. 28). This markedly enhances gas cross-jetting and increases turbulence, thereby increasing the resonance time of gas in the baffle assembly before existing the suppressor through the front exit opening 267 which improves muzzle blast suppression.

Primary baffles 300 may be made of any suitable preferably metallic or non-metallic material. The baffles 300 can be formed by any suitable method. In some fabrication processes, this compound baffle shape may be machined from a single piece of metal bar stock or investment cast to net shape and then finished by appropriate machining techniques. The invention is not limited by the production method(s) used.

Although primary baffles 300 have been described which incorporate the foregoing skewed cone design in the projectile pathway of the sound suppression device, the invention is not limited in its applicability to such baffle configurations alone. In other embodiments, numerous baffle variations and alternative shapes may be used including as some examples without limitation plain baffle apertures in a straight or angled baffle face, symmetrical cone designs on the baffle face, and others. Such other designs may be used in the integrally suppressed barrel system and mounting mechanism with equal benefit.

The foremost or front primary baffle 301 of baffles 300 has the same configuration as the rearward primary baffles previously described herein, with exception that it may be configured for mounting a front sight 281 thereto (see, e.g. FIGS. 1, 9, and 10). FIGS. 23-25 show front primary baffle 301 in detail. A transversely open dovetail slot 304 is formed in the top of outer wall 302 which receives a complementary configured protrusion 305 on the front sight 281. In one embodiment, the slot 304 may be formed in an upwardly projecting mounting protrusion 305 formed on the top of outer wall. This provides additional baffle material of greater thickness than other portions of outer wall 302 to facilitate forming the front primary baffle 301 therein. Other than the front sight mounting provisions, all other portions of the front primary baffles 301 are the same as the other primary baffles and will not be repeated here for sake of brevity.

It is notable that when the pistol 20 is fired, the internal vertical walls of the blast and primary baffles 240 and 300 (including front primary baffle 301) will repetitiously deflect or flex back and forth for several cycles each time when impinged by the high velocity combustion gases flowing through the baffles. This causes the baffles to vibrate at a resonant high frequency creating an audible bell-like pinging noise which is undesirable. The inventors have discovered that this high frequency noise can be effectively attenuated by selectively shaping and configuring the lower sections of the baffles to create angled sound reflection surfaces. According to one aspect of the invention, the multi-faceted polygonal configuration of the lower sections 245 and 163 of respective blast baffle 240 and primary baffles 300 already described above has been specifically designed to act as frequency modulators to advantageously ameliorate the resonant high frequency pinging noise. The polygonal lower sections of the baffles 240 and 300 therefore configured with the multiple angled flat surfaces within their respective gas expansion chambers 257 and 73 as shown in the figures, which reflect the sound waves internally within the baffles. This shifts the frequency of the audible resonant high frequency noise attributed to baffle vibration either higher or lower than can be heard by a user to eliminate or minimize the objectionable noise. In sum, the polygonal lower sections of the blast and primary baffle outer walls 243, 302 are configured to eliminate noise associated with the vibration of the baffles when the firearm is discharged. It therefore bears noting that the purpose of the polygonal shape of the lower sections has been engineered to serve an important sound reduction function, and is not simply one of aesthetics.

An example method for assembling the barrel assembly 20 will now be generally described. The method described herein is one of several possible sequential approaches for assembling the integrally suppressed barrel. Accordingly, numerous sequential variations are possible and the invention is not limited to any one approach.

Figure 11:
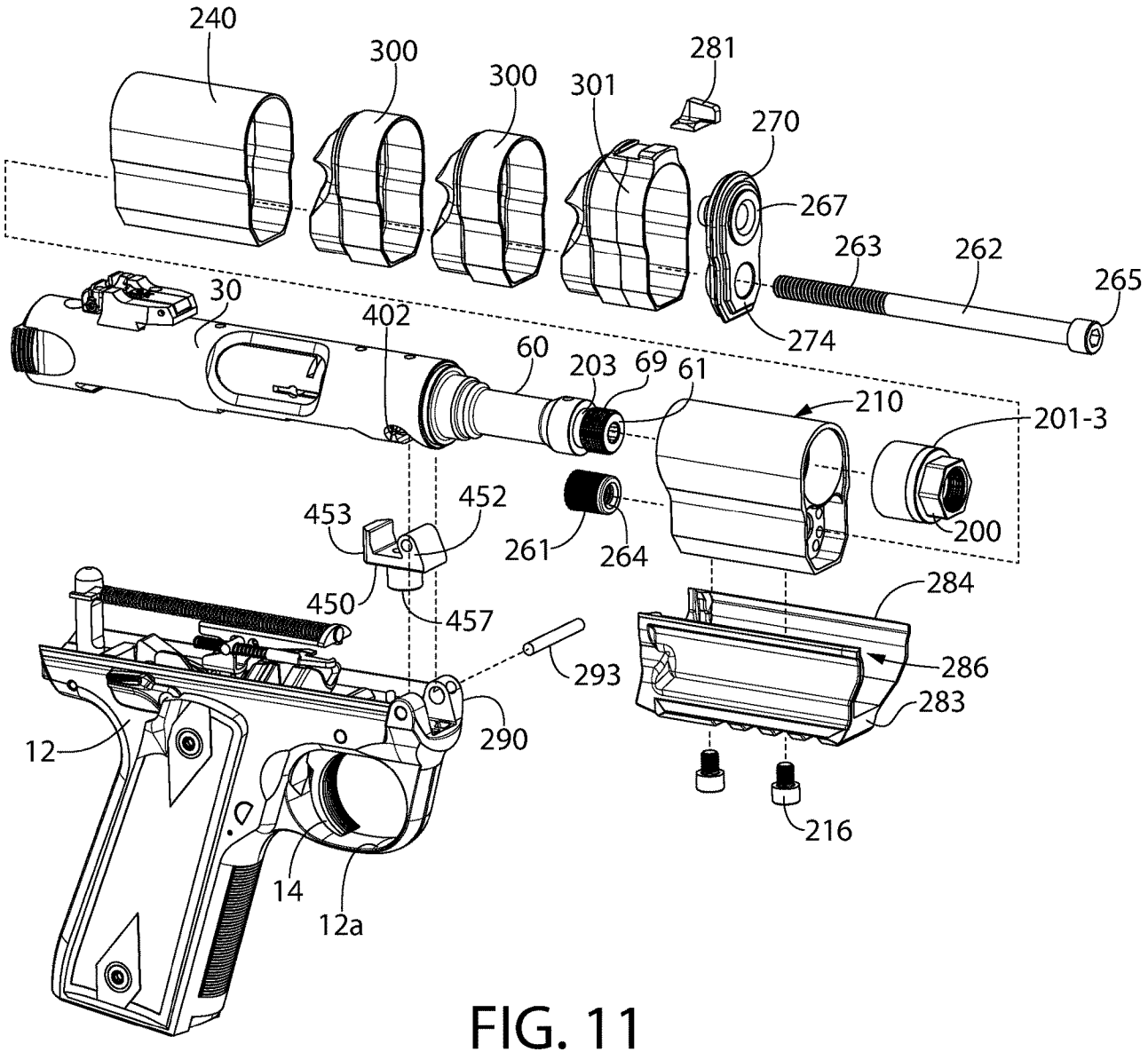
FIG. 11 is an exploded perspective view thereof.
Figure 12:
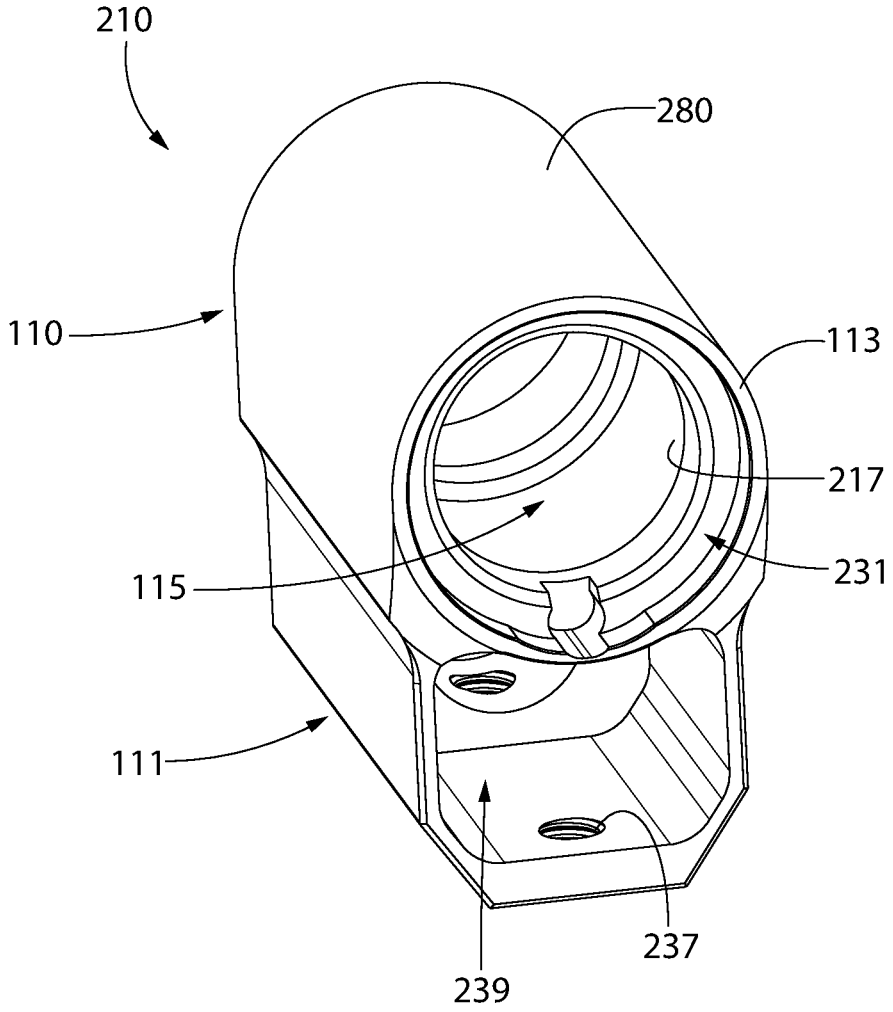
FIG. 12 is a rear perspective view of a suppressor assembly mounting adapter of the pistol.
Figure 13:
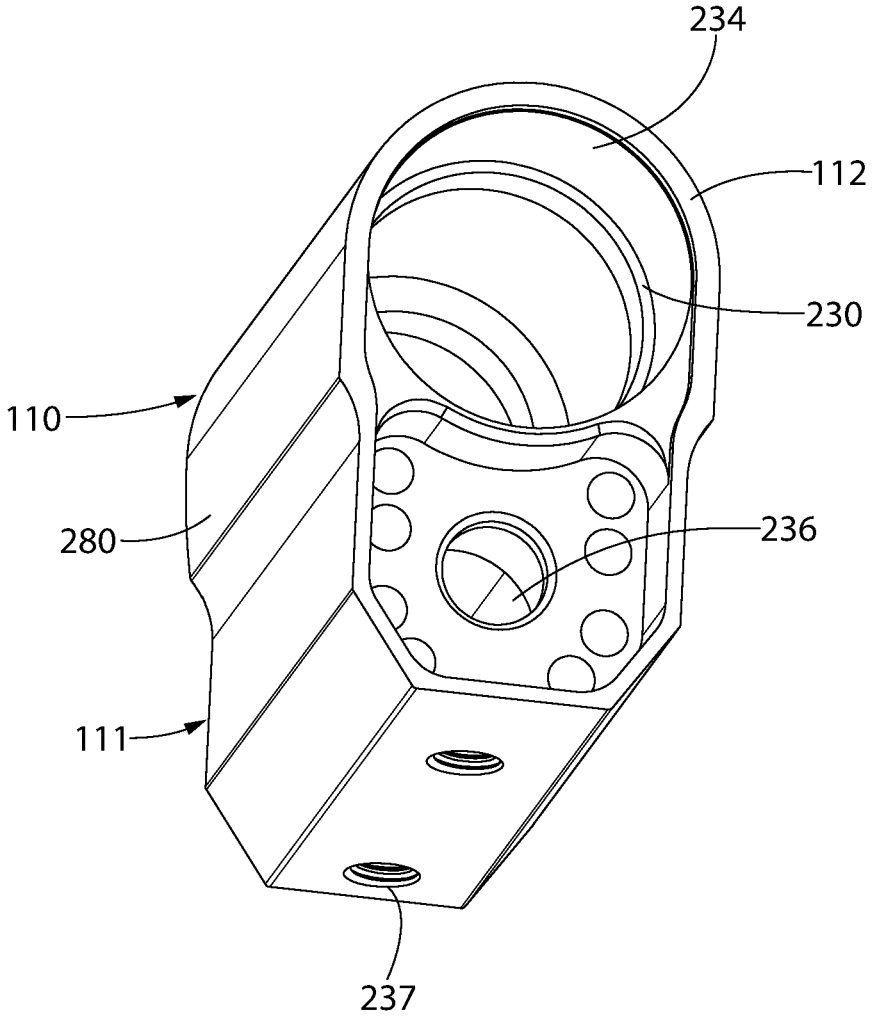
FIG. 13 is a front perspective view thereof.
Figure 14:
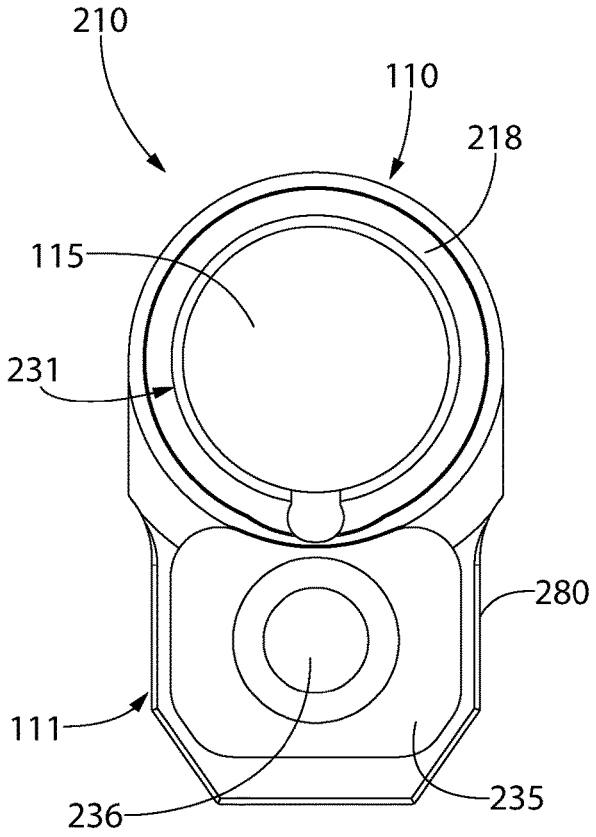
FIG. 14 is rear view thereof.
Figure 15:
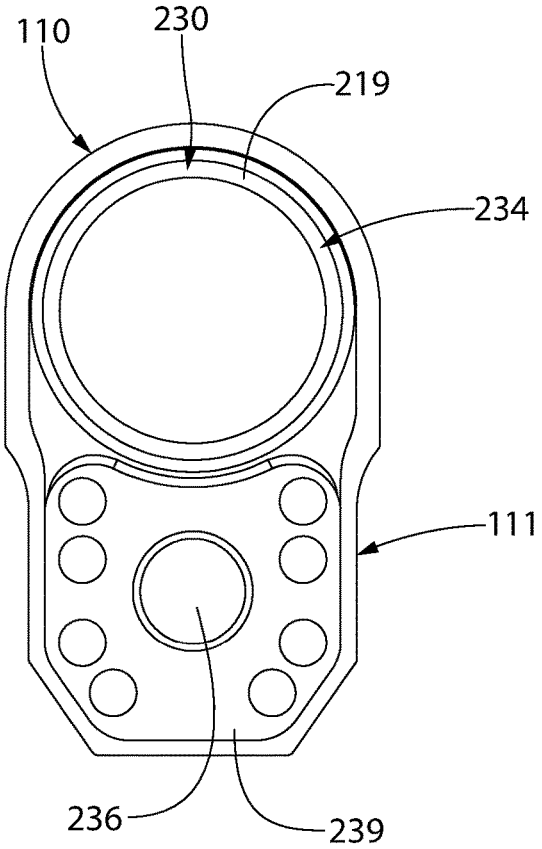
FIG. 15 is a front view thereof.
Figure 16:
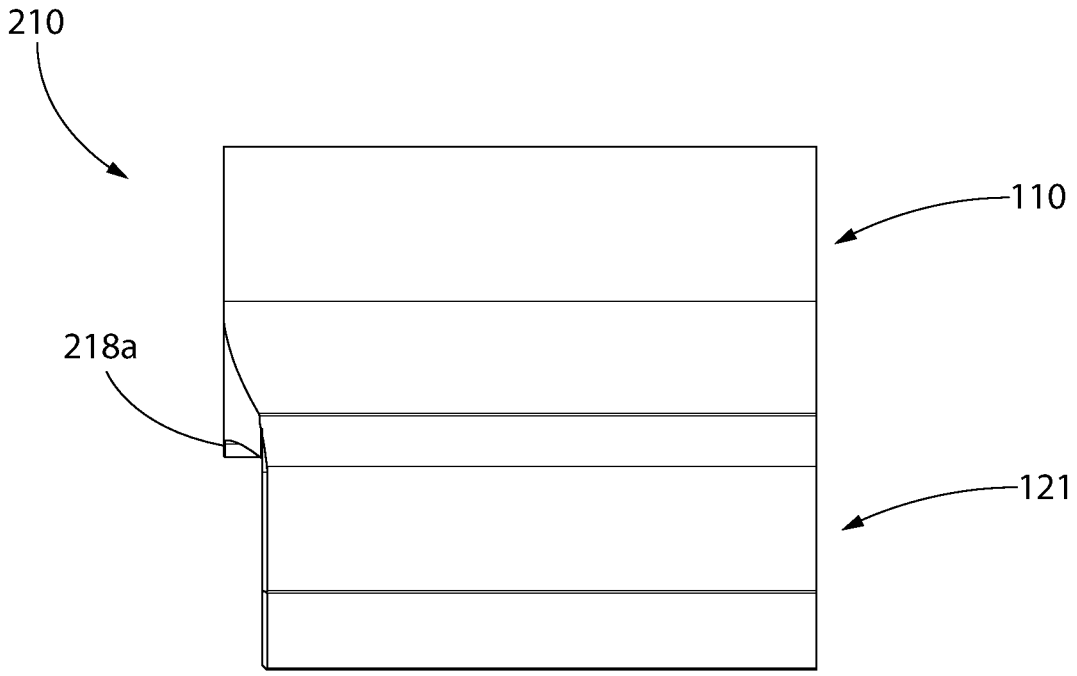
FIG. 16 is a side view thereof.
Figure 17:
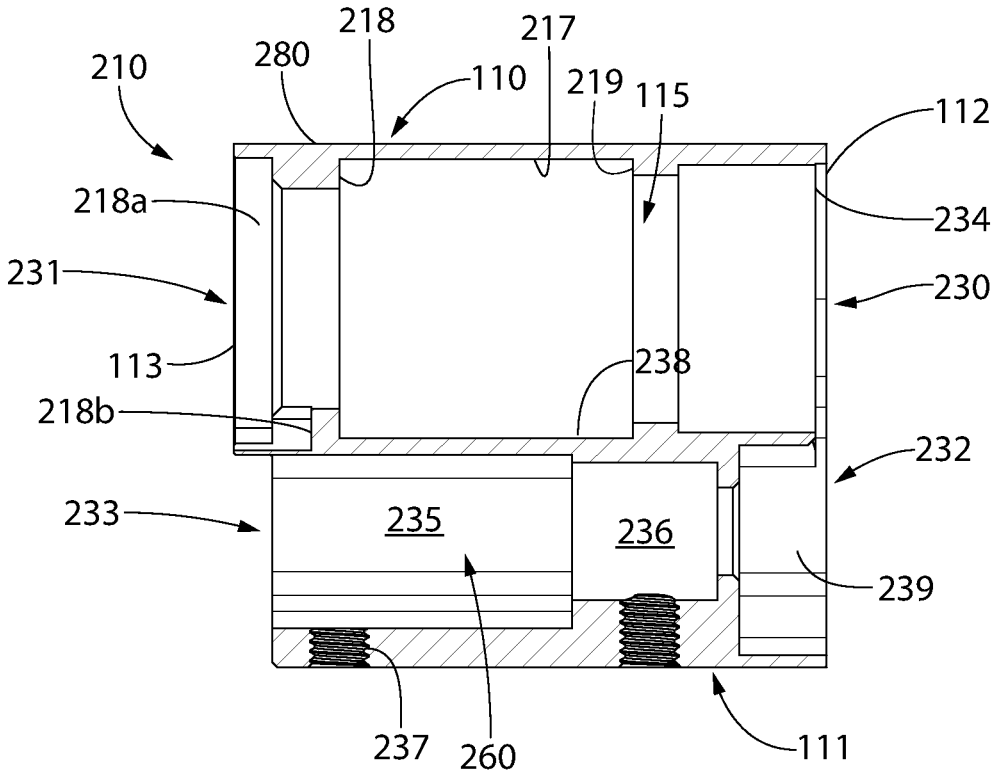
FIG. 17 is a side cross-sectional view thereof.
Figure 19:
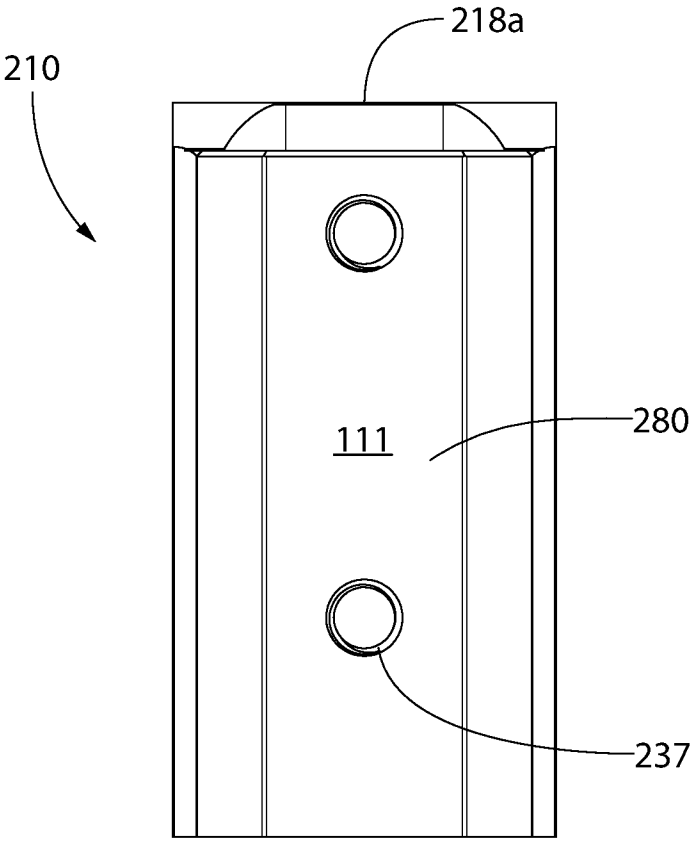
FIG. 19 is a bottom view thereof.
Figure 18:
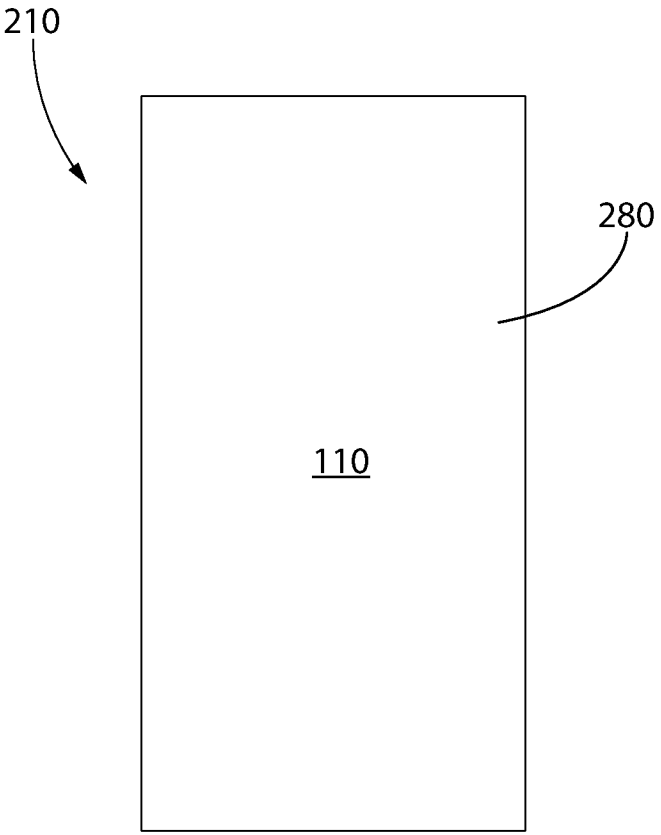
FIG. 18 is top view thereof.

The present method comprises initially providing the following unassembled major components of the integrally suppressed barrel system: the barrel insert 60, front end cap 270, blast baffle 240, a plurality of primary baffles 300 including one front primary baffle 301, rear mounting adapter 210, and baffle mounting rod 262. FIG. 11 shows these components in exploded view and a disassembled condition for reference with exception of the barrel insert 60 shown already mounted to the receiver 30.

As an initial step with respect to FIGS. 8-11, the mounting adapter 210 may first be removably mounted to the barrel insert 60. This is accomplished by sliding the mounting adapter 210 rearward over the barrel insert 60 to position the insert inside the upper through passage 115 of the adapter. The rear annular protrusion 218 of the adapter engages the annular flange 66 formed on mounting portion 63 of barrel insert 60, thereby trapping the flange 66 between the front end 31 of receiver 30 and annular protrusion 218. This correspondingly positions the front retention portion 64 of barrel insert 60 slightly forward of the front annular protrusion 219 of the mounting adapter 210. The threaded front extension 69 of the barrel insert 60 projects forward through the upper front opening 230 of mounting adapter 210. Muzzle cap 200 is then threaded onto front extension 69 until the rear end 201-2 of the cap abuttingly engages the inwardly and radially extending front annular protrusion 219 of the barrel insert 60 (best shown in FIGS. 9 and 10). The mounting adapter 210 is now removably affixed to the barrel insert and receiver 30, and prepared for installing the baffle assembly.

In one embodiment, the blast baffle 240 and primary baffles 300 (including front primary baffle 301) may first be press-fitted and frictionally interlocked together as previously described herein to form a self-supporting baffle unit. The front end cap 270 may be press-fitted to the front primary baffle 301. The pre-assembled baffle unit with end cap may then be axially aligned with the mounting adapter 210 and moved rearward to engage the latter. The rear end 242 of blast baffle 240 is abuttingly engaged with the front end 112 of the mounting adapter 210 already emplaced on the barrel insert 60. While holding the baffle unit against the mounting adapter, the mounting rod 262 is inserted through the end cap 270 and baffles 240, 300 to engage the threaded rear end 263 of the rod with the threaded socket 264 of threaded insert 261 in the mounting adapter 210. The mounting rod 262 is rotated using tooling socket 172 and a complementary shaped tool to tighten the rod. This applies an axially-acting compression force on the stack of baffles 240, 300 and front end cap 270, thereby compressing and locking the assembly to the pistol 10 as shown in FIGS. 9 and 10. The mounting rod 262 defines a mounting axis MA which is parallel to and below the longitudinal axis LA of the pistol 10 which coincides with the longitudinal bore 62 of barrel insert 60 and the projectile passageway P.

To remove the baffle assembly from the pistol, the foregoing process is simply reversed. This allows the entire stack of baffles 240 and 300 to be removed from the sleeve 41 intact with the front end cap 270 as a unit. Optionally, the mounting adapter 210 may be removed from the receiver and barrel insert 60 if desired by unthreading the muzzle cap 200 from the barrel insert, and sliding the adapter forward.

Optional accessory rail 215 may be mounted to the mounting adapter 210 either before installation of the foregoing baffle assembly or unit, or afterwards. If already in place, the accessory rail 215 facilitates installation of the baffle assembly unit by providing support for the baffle assembly unit until the mounting rod 265 can be fully tightened. Referring to FIGS. 1-3, 7, and 8-11, accessory rail 215 has a U-shaped body including a bottom wall 283 and pair of transversely spaced upright sidewalls 284 extending upwards therefrom. The bottom wall and sidewalls collectively define an interior longitudinal cavity 286. Cavity 286 is upwardly, forwardly, and rearwardly open concavity. Cavity 286 is configured and dimensioned to receive the lower section 111 of mounting adapter 210 therein in a manner that provides a close conformal fit to cross-sectional shape of the mounting adapter. The body of accessory rail 215 therefore preferably has a polygonal transverse cross-sectional shape which substantially matches the polygonal transverse cross-sectional shape of the lower section 111 of the mounting adapter 210 (perhaps best shown in FIG. 7). When mounted to the mounting adapter 210, accessory rail 215 protrudes forward beyond the front end 112 of the adapter to help support the blast baffle 240. Accordingly, accessory rail 215 preferably may have an axial length longer than the adapter in some embodiments. In one embodiment, the front end of the accessory rail 215 may terminate at a point between the front and rear ends of the blast baffle 240 when mounted to the pistol 10 as shown. In other embodiments, the accessory rail 215 may have shorter or longer lengths to allow attachment of various types and lengths of firearm accessories to the rail.

Accessory rail 215 may be mounted to the mounting adapter by at least one threaded fastener 216. In one embodiment, preferably at least two axially spaced mounting fasteners are provided. The threaded fasteners 216 are each screwed through the bottom wall 283 of the accessory rail and into corresponding downwardly open threaded sockets 237 formed in the bottom of the mounting adapter 210 (see also FIG. 17). In one configuration, an enlarged extend a step-shaped through hole 285 is formed in bottom wall 283 of the accessory rail 215 to facilitate mounting. Holes 285 each have a diameter large enough to receive the entire enlarged head of the mounting fasteners 216 therein so that the head is recessed into the accessory rail, as best shown in 9 and 10. This provides a neat appearance and importantly avoids interference with any firearm accessories mounted to the accessory rail 215. Cap head screws with hex tooling apertures in the heads may be used for threaded fasteners 216 in one embodiment as illustrated; however, it will be appreciated that other type screws or fasteners may be used.

Accessory rail 215 defines a plurality of axially spaced apart mounting protrusions 284 formed on the bottom wall 283 of the rail. In one embodiment, protrusions 284 may define a section of a dovetail Picatinny rail for mounting firearm accessories. Other types and shapes of mounting protrusions 284 however may be used. Any type of firearm accessory may be mounted to accessory rail 215, such as tactical lights, laser sights, etc.

To accommodate a tilting barrel-receiver assembly 20/30 as disclosed herein, accessory rail 215 may include a rearwardly open slot 287 formed in bottom wall 283 of the accessory rail. The slot 287 avoids interference with the trigger guard 12*a* when the barrel-receiver assembly is pivotably moved to the open position, as shown in FIG. 20.

Any suitable materials may be used for the integrally suppressed barrel assembly and its components described herein. Preferably, the components are formed of an appropriate metal including alloys (with exception of any seals as needed) such as aluminum, carbon steel, stainless steel, titanium, or other. In some representative but non-limiting examples, the front end cap 270 may be formed of aluminum or stainless steel. The mounting adapter 210 for example may be formed of carbon or stainless steel, or alternatively aluminum for weight reduction. The threaded muzzle cap 200 may preferably be formed of steel (e.g. stainless). The barrel insert 60 may be formed of steel (stainless or other alloy). The blast and primary baffles 240, 300 may be formed of stainless steel or aluminum as examples. Numerous metallic materials may be substituted.

As noted herein, the degree of sound suppression provided by the integrally suppressed barrel assembly 20 is easily customizable by adding or removing primary baffles 300. FIGS. 1-11 show an example of a long pistol configuration and concomitantly greater muzzle blast suppression performance. This configuration includes the front primary baffle 301 and two additional primary baffles 300 to maximize sound suppression. The mounting rod 262 may not protrude rearward from threaded insert 261 in mounting adapter 210 into the rear gas expansion chamber 235 in some embodiments as shown in FIGS. 9 and 10.

Figure 21A:
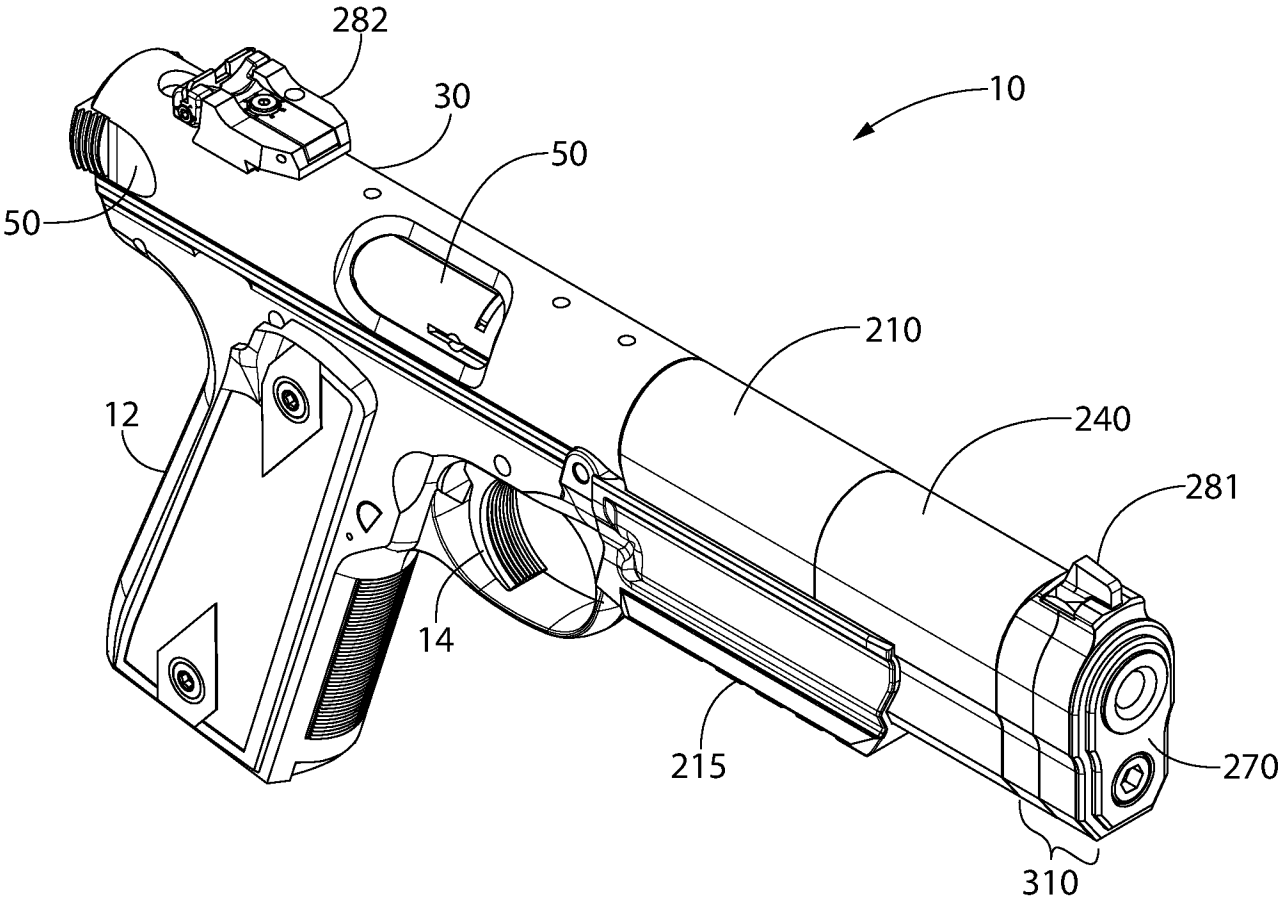
FIG. 21A is a perspective view of an alternative shorter configuration of the suppressor assembly of the pistol.
Figure 21B:
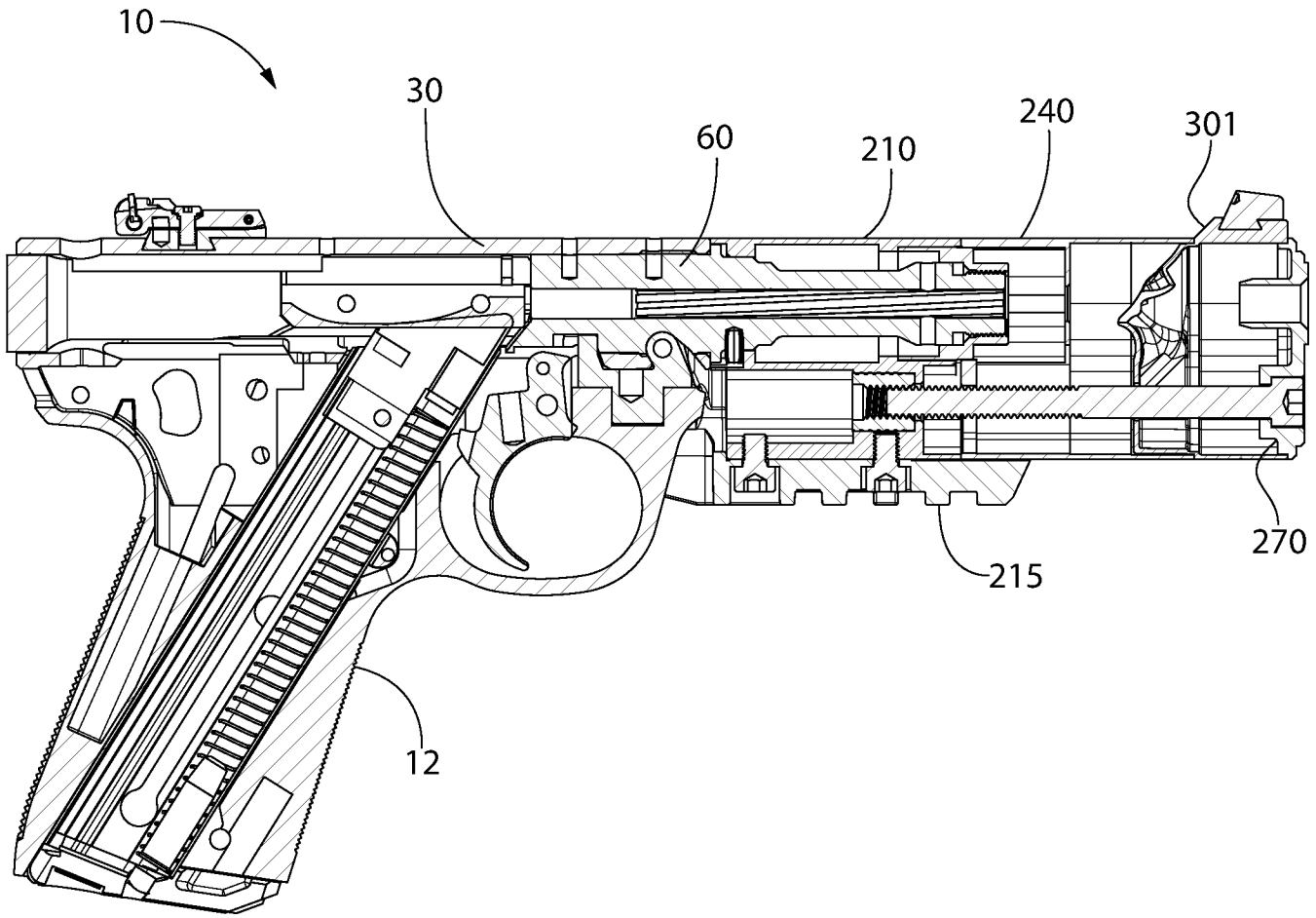
FIG. 21B is a side cross-sectional view thereof.

By contrast, FIGS. 21A-B show an example of a short pistol configuration and lesser sound suppression performance. Only the front primary baffle 301 is provided with no additional primary baffles rearward. In this shorter configuration, the threaded rear end 263 of mounting rod 262 would project a greater distance into the lower rear gas expansion chamber 235 of the mounting adapter 210 to compensate for the decreased length of the barrel assembly 20, as shown in FIG. 21B. Therefore, the same mounting rod may advantageously therefore be used by a user and/or manufacturer to configure pistol 10 for either the short or long configuration. By designing the length of the mounting rod 262 and rear gas expansion chamber 235 accordingly, a number of variations may be used to provide more or less than the number of primary baffles disclosed herein.

According to another aspect of the invention, an unsuppressed pistol is provided having a specialized OEM (original equipment manufacturer) firearm design and components which can be easily converted to an integrally suppressed firearm by the purchaser or end user using a conversion kit that includes the forgoing mounting and suppression components described herein. The OEM pistol and kit collectively define a firearm suppression conversion system and related method, to now be described.

FIGS. 32-37 disclose an unsuppressed convertible pistol 500 configured for conversion to an integrally suppressed pistol 500 using a suppressor conversion kit generally comprising a suppressor mounting adapter 210, blast baffle 240, primary baffles 300 (including front baffle 301), muzzle cap 200, mounting rod 262, and front end cap 270 previously described herein. In one embodiment, pistol 500 may be identical to pistol 10 previously described herein in details of construction and configuration. Pistol 500 may thus generally include receiver 30, barrel insert 60, bolt 50, and grip frame 12. In this first unsuppressed pistol configuration, however, the most notable exceptions are that there is no suppressor mounting adapter 210 or front suppressor portion or assembly including blast baffle 240 and array of primary sound suppression baffles 300. Instead, a barrel sheath or shroud 502 is provided which encases the barrel insert 60 of same configuration previously described. This allows the barrel insert 60 to be retained and remain intact when the pistol is converted to an integrally suppressed pistol.

Barrel shroud 502 has an axially elongated and tubular body including an open front end 501, open rear end 503, and circumferentially-extending sidewall extending therebetween. An internal axial bore 507, which extends between the ends, is configured to receive barrel 60 therein. Proximate to the rear end 503 is an internal annular shoulder 509 configured to engage annular mounting flange 66 of barrel insert 60 which is abuttingly engaged with the front end 31 of receiver 30. The shroud 502 may include one or more threaded sockets 510 for mounting the front sight 581 thereto via threaded fasteners. Front sight 581 differs in configuration from front sight 281 previously described and shown which is adapted for mounting to the foremost baffle 301. Barrel shroud 502 is preferably made of a suitable metal, such as for example without limitation steel, aluminum, titanium, or other.

An alternate muzzle cap 504 may be provided as shown to removably secure the barrel shroud 502 to the barrel insert 60 as shown. The muzzle cap 504 is threadably coupled to threaded extension 69 of the barrel insert 60. Muzzle cap 504 may be more aesthetically pleasing to the user than muzzle cap 200 since it remains visible unlike the functionally configured muzzle cap 200 which is enclosed inside silencer mounting adapter 210 and concealed from view in the integrally suppressed pistol 10. In some embodiments, muzzle cap 210 may instead be used or muzzle cap 504 can be used with the suppressed pistol. A washer 506 may be provided to assist with securement of muzzle cap 504 to the threaded extension 69 of the barrel insert 60.

When the barrel shroud 502 is mounted to the unsuppressed pistol 500, and particularly to barrel insert 60, it bears noting that the radial gas ports 67*a* are blocked off by the shroud and are inactive. The interior surface of the barrel shroud 502 occludes the ports 67*a*, which causes the combustion gas to follow the path of least resistance through the open front muzzle end of the barrel insert when the pistol is fired.

A method for converting unsuppressed pistol 500 into an integrally suppressed pistol 10 using the firearm suppression conversion system with conversion kit will now be described. The method begins by providing pistol 500 as originally supplied by the firearm OEM in its first unsuppressed configuration with barrel shroud 500 intact. The user first unthreads/unscrews and removes muzzle cap 504 from barrel insert 60. Barrel shroud 502 is next removed by axially sliding it forward and disengaging the barrel insert. The removed parts may be retained for use at a later time to return pistol 500 to its original condition.

Using the suppression conversion kit which has been provided, the user next mounts the suppressor mounting adapter 210 on the barrel insert 60 by sliding it axially rearward over the insert. Muzzle cap 200 is threaded onto the barrel insert 60. Alternatively, muzzle cap 504 may instead be used. The mounting adapter 210 is now secured to the receiver 30 and barrel insert. Next, the baffle assembly comprising the blast baffle 240 and primary baffles 300 are mounted to the mounting adapter in the same manner previously described herein using the threaded mounting rod 262 to secure the baffles to the adapter. It bears noting that with mounting adapter 210 in place in lieu of the barrel shroud 502, the radial gas ports 67*a* are now uncovered and active. A portion of the combustion gas will therefore be exhausted through the ports 67*a* when the pistol is fired and follow the flow path previously described herein. The same pistol used to start the conversion process is now in a second integrally suppressed configuration.

Advantageously, the foregoing conversion is easily accomplished without resort to a gunsmith. In addition, the user may return the firearm to the original unsuppressed configuration by simply reversing the foregoing process or method.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. An integrally suppressed handgun comprising: a longitudinal axis; a frame; a receiver attached to the frame; an elongated barrel insert comprising a rearward mounting portion fixedly coupled to the receiver and a forward retention portion, the barrel insert comprising a rear breech end defining a chamber configured for holding an ammunition cartridge, a front end, and a longitudinally-extending barrel bore defining a projectile pathway; the barrel insert further comprising a plurality of radial gas ports in fluid communication with the barrel bore; a suppressor mounting adapter at least partially surrounding and removably coupled to the barrel insert, the suppressor mounting adapter comprising an upper through passage receiving the barrel insert at least partially therein and a lower through passage; an annular gas expansion chamber formed between the barrel insert and the suppressor mounting adapter in the upper through passage; a threaded muzzle cap removably coupling the suppressor mounting adapter to the barrel insert; a baffle assembly removably coupled to the suppressor mounting adapter and defining a front end of the handgun including a projectile exit aperture, the baffle assembly comprising a plurality of sound suppression baffles arranged in longitudinally stacked relationship, each baffle defining an internal baffle gas expansion chamber; and an elongated mounting rod extending from the front end of the baffle assembly rearward to the suppressor mounting adapter, a threaded rear end of the mounting rod threadably coupled to the suppressor mounting adapter to retain the baffle assembly; wherein when the handgun is discharged, the annular gas expansion chamber fills with combustion gas vented from the gas ports of the barrel insert.

2. The integrally suppressed handgun according to claim 1, wherein the mounting adapter is configured and operable to direct the gas from the gas expansion chamber back through the gas ports and into barrel bore.

3. The integrally suppressed handgun according to claim 2, wherein the gas expansion chamber is only in fluid communication with the baffle assembly via the gas ports and the barrel bore of the barrel insert.

4. The integrally suppressed handgun according to claim 3, wherein the lower through passage of the mounting adapter includes a forwardly open front chamber in fluid communication with the baffle assembly and a rear chamber fluidly isolated from the front chamber.

5. The integrally suppressed handgun according to claim 4, wherein the lower through passage is fluidly isolated from the gas expansion chamber of the upper through passage by a horizontal partition wall extending longitudinally between the upper and lower through passages.

6. The integrally suppressed handgun according to claim 4, wherein the mounting rod extends through the front chamber to threadably engage the mounting adapter.

7. The integrally suppressed handgun according to claim 6, wherein the mounting rod threadably engages an internally threaded through socket disposed between the front and rear chambers of the lower through passage.

8. The integrally suppressed handgun according to claim 7, wherein the mounting rod is extendible and retractable into and out of the rear chamber of the lower through passage to vary a projected length of the mounting rod from the mounting adapter for accommodating different numbers of baffles in the baffle assembly.

9. The integrally suppressed handgun according to claim 1, wherein the barrel insert further comprises an intermediate portion between the forward retention portion and the rearward mounting portion, the intermediate portion having a reduced cross-sectional area relative to the forward retention portion and the rearward mounting portion creating a volume of the annular gas expansion chamber.

10. The integrally suppressed handgun according to claim 1, wherein the muzzle cap threadably engages the forward retention portion of the barrel insert to couple the mounting adapter to the barrel insert.

11. The integrally suppressed handgun according to claim 10, wherein the muzzle cap threadably engages a reduced diameter threaded extension projecting forward from the forward retention portion of the barrel insert through an axial opening formed in the mounting adapter which receives a rear portion of the muzzle cap.

12. The integrally suppressed handgun according to claim 1, wherein the mounting adapter further comprises an internal annular protrusion that defines an axial opening through which the forward retention portion of the barrel insert extends, the annular protrusion engaged by a rear end of the muzzle cap to lock the mounting adapter to the barrel insert.

13. The integrally suppressed handgun according to claim 1, wherein the muzzle cap includes a rearwardly open gas inlet chamber in fluid communication with the radial gas ports of the barrel insert and the gas expansion chamber of the mounting adapter, the gas inlet chamber configured to receive the gas from the barrel insert in a radial direction transverse to the longitudinal axis, and to direct the gas axially rearward into the gas expansion chamber.

14. The integrally suppressed handgun according to claim 1, wherein a front suppressor portion of the handgun comprising the mounting adapter and baffle assembly has a vertically oblong body having a height which is greater than its width.

15. The integrally suppressed handgun according to claim 14, wherein each baffle includes an upper section that defines an upper part of the baffle gas expansion chamber and a lower section that defines a lower part of the baffle gas expansion chamber.

16. The integrally suppressed handgun according to claim 15, wherein the upper section has a top having an arcuate convex shape in transverse cross section and straight sides, and the lower section has a multi-faceted polygonal shape in transverse cross section.

17. The integrally suppressed handgun according to claim 15, wherein the baffles include a rearmost blast baffle coupled to the mounting adapter and a longitudinal stack of primary baffles coupled in turn to the blast baffle, the blast baffle having a different configuration than the primary baffles.

18. The integrally suppressed handgun according to claim 17, wherein the rearmost primary baffle has a frictional press fit interface to the blast baffle and each primary baffle has a frictional press fit interface to an adjacent primary baffle forming a sealed pressure retention boundary, the blast and primary baffles configured to form a self-supporting structure without the mounting rod.

19. The integrally suppressed handgun according to claim 18, wherein each of the blast and primary baffles includes an outer wall that forms an exposed exterior surface of the baffle assembly.

20. The integrally suppressed handgun according to claim 17, wherein each baffle includes an asymmetric flow cone projecting axially rearward from the upper section towards the mounting adapter, the cone defining an oblong central opening concentrically aligned with and obliquely oriented to the longitudinal axis for receiving a projectile therethrough.

21. The integrally suppressed handgun according to claim 14, wherein the mounting adapter and plurality of baffles include outer walls having a vertically elongated complementary configuration in cross-sectional shape and dimensions to form a uniform profile of the handgun.

22. The integrally suppressed handgun according to claim 17, wherein the blast baffle includes an upper rear blast chamber which receives gas directly from the muzzle end of the barrel insert, and a lower rear chamber which receives a portion of the gas from the upper rear blast chamber.

23. The integrally suppressed handgun according to claim 22, further comprising a vertical partition wall spaced inwardly between a front end and a rear end of the blast baffle which acts to divert a portion of gas from the upper rear blast chamber downwards into the lower rear chamber, wherein the blast and lower rear chambers are disposed rearward of the partition wall, and the blast baffle further comprises a common front gas expansion chamber disposed forward of the partition wall which receives gas from both the blast and lower rear chambers.

24. The integrally suppressed handgun according to claim 1, further comprising an accessory rail removably mounted to an underside of the mounting adapter via threaded fasteners.

25. The integrally suppressed handgun according to claim 1, wherein the barrel and receiver define a barrel-receiver assembly which is pivotably mounted to the frame, the barrel-receiver assembly being movable between a closed position axially aligned with the longitudinal axis of the handgun, and a tilted open position obliquely angled to the longitudinal axis along with the mounting adapter and baffle assembly.

26. An integrally suppressed handgun comprising:

a longitudinal axis;

a frame;

a receiver supported by the frame;

an elongated barrel insert comprising a rearward mounting portion fixedly coupled to a front end of receiver, a forward retention portion, and an intermediate portion therebetween;

the barrel insert comprising a rear breech end defining a chamber configured for holding an ammunition cartridge, a front end, and a longitudinally-extending barrel bore defining a projectile pathway;

the barrel insert further comprising a plurality of radial gas ports in fluid communication with the barrel bore;

a mounting adapter configured for attaching a suppressor baffle assembly thereto, the mounting adapter at least partially surrounding the barrel insert and abuttingly engaging the receiver;

a muzzle cap threadably coupled to the forward retention portion of the barrel insert to secure the mounting adapter to the receiver;

the muzzle cap comprising a forward tooling portion configured for engaging a tool used to couple the muzzle cap to the barrel insert, and a rear shield portion defining a rearwardly open inlet gas chamber in fluid communication with the radial gas ports of the barrel insert;

the mounting adapter further defining an internal annular gas expansion chamber surrounding the barrel insert, the annular gas expansion chamber in fluid communication with the radial gas ports of the barrel insert via the inlet gas chamber of the muzzle cap;

wherein when the handgun is discharged, combustion gas is vented from the barrel bore into the gas inlet chamber of the muzzle cap through the radial gas ports, and then fills the annular gas expansion chamber.

27. The integrally suppressed handgun according to claim 26, wherein the mounting adapter further comprises an internal first annular protrusion that defines an axial opening through which the forward retention portion of the barrel insert extends, the first annular protrusion engaged by a rear end of the muzzle cap to lock the mounting adapter to the barrel insert.

28. The integrally suppressed handgun according to claim 27, wherein the mounting adapter further comprises a rear end which abuttingly engages the front end of the receiver, and an internal second annular protrusion engaging and compressing an annular flange on the barrel insert against the front end of the receiver.

29. The integrally suppressed handgun according to claim 26, wherein:

the baffle assembly is removably coupled to the mounting adapter and defines a front end of the handgun including a projectile exit aperture in communication with the bore of the barrel insert;

the baffle assembly comprising a blast baffle affixed to the mounting adapter and a longitudinal stack of sound suppression primary baffles, each of the blast and primary baffles defining an internal baffle gas expansion chamber; and an elongated mounting rod extending from the front end of the baffle assembly rearward to the mounting adapter, a threaded rear end of the mounting rod threadably coupled to the mounting adapter to retain the baffle assembly in compression to the mounting adapter;

wherein the blast baffle and primary baffles are configured for forming a gas-tight press-fitted frictional interlock to each other forming a self-supporting baffle assembly.

30. The integrally suppressed handgun according to claim 29, wherein a first portion of the gas flows from the barrel insert into an upper rear blast chamber of the blast baffle and then forward through the first and second upper apertures into the baffle assembly, and a second portion of the gas from the barrel insert flows from the upper rear blast chamber into a lower rear chamber of the blast baffle and then forward through the first and second lower apertures into the baffle assembly.

31. The integrally suppressed handgun according to claim 26, wherein after the handgun is discharged and the annular gas expansion chamber fills with combustion gas vented from the gas ports of the barrel insert, the handgun is configured and operable to draw the gas back into the gas inlet chamber of the muzzle cap, the gas ports, and into the barrel bore.

32. The integrally suppressed handgun according to claim 26, wherein the intermediate portion of the barrel insert is a reduced diameter section having a smaller diameter than the forward retention portion and the rearward mounting portion.

* * * * *